US007358950B2

(12) United States Patent
Yamashita et al.

(10) Patent No.: US 7,358,950 B2
(45) Date of Patent: Apr. 15, 2008

(54) SIGNAL PROCESSING CIRCUIT, LOW-VOLTAGE SIGNAL GENERATOR, AND IMAGE DISPLAY INCORPORATING THE SAME

(75) Inventors: Hidehiko Yamashita, Oxford (GB); Hajime Washio, Sakurai (JP); Yasushi Kubota, Sakurai (JP); Graham Andrew Cairns, Oxford (GB); Michael James Brownlow, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 1007 days.

(21) Appl. No.: 10/145,905

(22) Filed: May 16, 2002

(65) Prior Publication Data

US 2002/0180722 A1 Dec. 5, 2002

(30) Foreign Application Priority Data

May 18, 2001 (JP) ..... 2001-150163
Mar. 26, 2002 (JP) ..... 2002-087012

(51) Int. Cl.
*G09G 3/36* (2006.01)

(52) U.S. Cl. ..... 345/98; 345/100; 326/62

(58) Field of Classification Search ..... 345/98–100; 326/62–79; *H03K 19/0175; G09G 3/36*
See application file for complete search history.

(56) References Cited

U.S. PATENT DOCUMENTS 5,266,848 A 11/1993 Nakagome et al.
5,311,083 A 5/1994 Wanlass
5,576,737 A * 11/1996 Isozaki ..... 345/211
5,635,859 A * 6/1997 Yokota et al. ..... 326/67
5,920,203 A * 7/1999 Bailey et al. ..... 326/68
6,081,131 A 6/2000 Ishii
6,157,361 A * 12/2000 Kubota et al. ..... 345/100
6,232,937 B1 * 5/2001 Jacobsen et al. ..... 345/87
6,249,145 B1 * 6/2001 Tanaka et al. ..... 326/68

(Continued)

FOREIGN PATENT DOCUMENTS

JP 04-372220 12/1992

(Continued)

OTHER PUBLICATIONS

Hara, "MOS Integrated Circuits Primer", Published on May 30, 1992, pp. 224-229.

(Continued)

*Primary Examiner*—Sumati Lefkowitz
*Assistant Examiner*—Ke Xiao
(74) *Attorney, Agent, or Firm*—Nixon & Vanderhye P.C.

(57) ABSTRACT

There are provided: a first logic operation circuit which performs a logic operation using a high-amplitude logic signal; a transmission system having a load capacitance; and a low-voltage signal generator which is a step-down level shifter transforming an incoming high-amplitude logic signal from the first logic operation circuit to a low-amplitude logic signal having a lower amplitude than the high-amplitude logic signal for output to the transmission system. In the configuration, the first logic operation circuit operates based on a high-amplitude logic signal, and is therefore free from malfunctions and performs operations at high speed. Further, the transmission system introducing a load capacitance transmits a low-amplitude logic signal and therefore restrains increases in electric power consumption and occurrence of unnecessary radiation.

18 Claims, 24 Drawing Sheets

U.S. PATENT DOCUMENTS

| | | | | |
|---|---|---|---|---|
| 6,307,398 | B2 * | 10/2001 | Merritt et al. | 326/81 |
| 6,542,144 | B2 * | 4/2003 | Kogure et al. | 345/98 |
| 2003/0174115 | A1 | 9/2003 | Washio et al. | |

FOREIGN PATENT DOCUMENTS

| | | | | |
|---|---|---|---|---|
| JP | 6-95073 | A | | 4/1994 |
| JP | 08286794 | A | * | 11/1996 |
| JP | 09-325318 | | | 12/1997 |
| JP | 11-183530 | | | 7/1999 |
| JP | 11-272240 | A | | 10/1999 |
| JP | 2000-75842 | A | | 3/2000 |
| JP | 2000-163003 | A | | 6/2000 |

OTHER PUBLICATIONS

Chinese Office Action mailed Jun. 10, 2005 (w/English translation thereof).

* cited by examiner

SIGNAL PROCESSING CIRCUIT, LOW-VOLTAGE SIGNAL GENERATOR, AND IMAGE DISPLAY INCORPORATING THE SAME

FIELD OF THE INVENTION

The present invention relates to a signal processing circuit performing logic operations, including that which feeds a signal to be applied to a liquid crystal or other image display apparatus, and further to a low-voltage signal generator generating a low-voltage signal used therein, and an image display incorporating such a circuit.

BACKGROUND OF THE INVENTION

Among those devices with a large-scale transmission circuit, image displays are known in which liquid crystal devices, EL (electroluminescence) devices, LEDs (light-emitting diodes), or the like are arranged in a matrix. An example of such a matrix-type image display is shown in FIG. 28 as a liquid crystal display 101 constituted by a display unit 102 including pixels PIXs arranged in a matrix and a data signal line drive circuit 103 and a scan signal line drive circuit 104 which drive the pixels PIXs. A control circuit 105 produces a video signal DAT indicative of the display state of each pixel PIX, and an image is displayed based on the video signal DAT. A brief explanation is now given about how the display 101 works. In the data signal line drive circuit 103, a shift register sequentially transfers pulses on a signal line $S_n$ to a signal line $S_{n+1}$ in synchronism with a timing signal, such as a clock signal SCK. From the transferred pulses are produced sampling pulses. The sampling unit 103*b* acquires the incoming video signal DAT in synchronism with the sampling pulses and writes the acquired signal to data signal lines SD. Meanwhile, in the scan signal line drive circuit 104, a shift register sequentially transfers pulses on a scan signal line $GL_n$ to a scan signal line $GL_{n+1}$ in synchronism with a timing signal, such as a clock signal GCK. From the transferred pulses are produced gate pulses for selecting the scan signal line $GL_n$. The opening/closing of the switching elements in the pixels PIXs is controlled using the gate pulses, to write the video signals (data) written to the data signal lines SD to the pixels PIXs and sustain the data written to the pixels PIXs.

In recent years, a technology is in the spotlight which is capable of integrally fabricating a pixel array and its drive circuits controlling the display on a single substrate for various purposes, including miniaturization of the liquid crystal display, enhancement of its resolution, and reduction in its packaging costs. To build a currently popular transmissive liquid crystal display with integrated drive circuits, a transparent substrate must be used. Therefore in many cases, silicon thin film transistors made of polysilicon, which can be fabricated on a substrate made of quarts or other glasses, are used as active elements.

The silicon thin film transistor made of polysilicon (hereinafter, "polysilicon TFT") has a mobility of about 10-100 $cm^2/V\cdot s$ and a threshold value in a range of +1V to +4V when built as an N type and −1V to −4V when built as a P type. For the circuit to operate, the source voltage and the input logic amplitude must be sufficiently high compared to TFT's threshold values. Therefore a voltage of 10 V to 12 V is necessary for a polysilicon-TFT-based circuit to operate.

Incidentally, liquid crystal displays are used as monitors in PDAs (Personal Digital Assistants), mobile telephones, and other mobile information devices and for desktop personal computers. These machines are built around ICs and LSI circuits made of monocrystalline silicon and operate on signal voltages as high as 3 V to 5 V. A conventionally liquid crystal panel was provided with a built-in level shifter to raise the low-amplitude logic input control signal from 3 V to about 12 V to address the problem. This solution is disclosed in, for example, Tokukaihei 11-272240/1999 (Japanese Laid-open Patent Application No. 11-272240, published on Oct. 8, 1999) and U.S. Pat. No. 6,081,131 (Date of Patent: Jun. 27, 2000). According to the disclosed technique, a level shifter is provided as shown in FIG. 29, so that signals pass through the level shifter before being fed to the data signal line drive circuit 103 and the scan signal line drive circuit 104. The level shifter shifts the level of the incoming low-amplitude logic control signal to produce an output to those shift registers in the drive circuits.

The technique has setbacks: the shift registers are clocked to a high-amplitude logic signal and in addition, the high-amplitude logic signal must travel a distance substantially as long as the data signal line drive circuit 103.

Now, we calculate how large a load capacitance the clock wire for a shift register has. FIG. 30 shows a typical shift register constituted by D-type flip flops. Clock wires (CK and CKB) are connected to each stage in the shift register. In each stage, both clock wires are connected to two transistors at their gates, a configuration providing a load gate capacitance.

The wires themselves form capacitive coupling with a base, and the capacitance of a wire is given by the following expression:

$$\begin{aligned} C_{wire} &= C_{plate} + C_{fringe} \qquad (1) \\ &= \epsilon_{ox}(W - T/2)L/H + \epsilon_{ox}\cdot 2\pi L/\ln[1 + 2H(1 + (1 + T/H)^{1/2})/T] \\ &= \epsilon_{ox}\{(W - T/2)/H + 2\pi/\ln[1 + 2H(1 + (1 + T/H)^{1/2})/T]\}L \end{aligned}$$

where $C_{wire}$ is the total capacitance of the wire, $C_{plate}$ is the capacitance of the wire assuming that the wire is parallel to base plates, and $C_{fringe}$ is the capacitance due to fringe effect of the wire. The expression is derived using an equivalence model shown in FIGS. 31(*a*), 31(*b*) (*Basics of MOS Integrated* Circuit written and edited by HARA Hisashi, published by Kindai Kagakusha (*Modern Science Publishing*)) in which the effect of the fringe capacitance $C_{fringe}$ is replaced with a column wire. In the equations and the figure, W, L, and T are respectively the width, length, and thickness of the wire, and H and $\epsilon_{ox}$ are respectively the thickness and dielectric constant of a field oxidation film. As would be clearly understood from the expression, the wire capacitance increases in direct proportion to the wire length L. Besides this, adjacent wires form capacitive coupling between them, and its effect is also in direct proportion to the wire length L.

In short, the load capacitance of the clock wire increases in direct proportion to the number of stages in the shift register and also to the length of the wire.

Meanwhile, provided that there is no static current consumption, the electric power consumption in signal transmission is given as the following expression:

$$P = C_L f V^2 \qquad (2)$$

where P is the electric power consumption, $C_L$ the load capacitance, f the operating frequency, and V operating voltage.

Expressions (1), (2) show that the electric power consumption increases in direct proportion to the distance that a signal travels in a wire having a load and also to the square of the amplitude of the logic signal. Therefore, in the aforementioned conventional example in which a low-amplitude logic input control signal is stepped up by a level shifter to produce outputs to the data signal line drive circuit and the scan signal line drive circuit, large electric power consumption occurs in the clock wire. The distribution of high-amplitude logic, high-frequency clock wires across the entire substrate will likely cause undesirable radiation.

For comparison, FIG. 32 shows a part of a signal line drive circuit or a scan line drive circuit in a liquid crystal display prepared using the polysilicon mentioned in Tokukaihei 6-95073 (published on Apr. 8, 1994). A shift register 201 operates with a low-amplitude logic signal. The output of the shift register 201 is stepped up by the level shifter 202 to a high-amplitude logic signal which is used in driving liquid crystal. The document asserts that the configuration allows the clock wire to carry only the low-amplitude logic signal and thus restrains electric power consumption and unnecessary radiation. However, in this prior art, the shift register is composed of polysilicon, which is inferior to the aforementioned monocrystalline silicon both in mobility and threshold value, and driven by low-amplitude logic signals. The shift register therefore has a smaller drive voltage margin and will likely result in a higher rate of malfunctions and a less drive speed than in a case where a high-amplitude logic signal is used.

In contrast, Tokukai 2000-75842 (Japanese Laid-open Patent Application 2000-75842, published on Mar. 14, 2000) and Tokukai 2000-163003 (Japanese Laid-open Patent Application 2000-163003, published on Jun. 16, 2000) are summarized as follows. FIG. 33 is a diagram showing a typical shift register constituted by D-type flip flops. The shift register 301 is made up of D-type flip flops 302*a*, 302*b*, . . . which are connected in series. According to Tokukai 2000-75842 and Tokukai 2000-163003, as shown in FIG. 34, a logic signal transmitted with low amplitude on the clock wire is stepped up by level shifters 303*a*, 303*b*, . . . distributed in respective stages to produce a high-amplitude logic signal which is fed to the shift register. Electric power consumption in the clock wire, which is a transmission system, is thus reduced. Further, the shift register operating with a high-amplitude logic signal can improve the operating margin and drive speed of the shift register, which was an issue with Tokukaihei 6-95073.

However, in the shift registers, disclosed in Tokukai 2000-75842 and Tokukai 2000-163003, which include a built-in level shifter coupled to the clock signal input of each stage, the clock signal is a logic signal with a low amplitude from an external control circuit to a level shifter in the shift register in a signal line drive circuit or a scan line drive circuit in a liquid crystal panel. Therefore, if logic operations using a signal from the control circuit are required before the signal line drive circuit or scan line drive circuit in the liquid crystal panel, the use of this low-amplitude logic signal causes practical problems, that is, the aforementioned malfunctions due to a smaller voltage operating margin for operations and slow operating speed. For example, to reduce the drive frequency of the shift register in the data signal line drive circuit, a multiphase shift register may be used, in which event the clock signal from an external circuit must be subjected to a dividing process. As mentioned earlier, the characteristics of polysilicon TFTs are insufficient to carry out these logic operations, and a high-amplitude logic signal is required.

In this manner, in a device using polysilicon TFTs, a high-amplitude logic signal is necessary to a signal operating unit, while a low-amplitude logic signal is demanded in long and large-scale transmission systems to cut electric power consumption and undesirable radiation.

SUMMARY OF THE INVENTION

The present invention, conceived to address the problems, has an objective to offer a signal processing circuit capable of restraining increase in electric power consumption and occurrence of unnecessary radiation in an arrangement including a logic operation unit which requires a high-amplitude logic signal and also to offer a low-voltage signal generator which produces a low-voltage signal used in the signal processing circuit and an image display incorporating the signal processing circuit.

To achieve the objective, a signal processing circuit in accordance with the present invention is characterized in that it includes:

a first logic operation circuit which performs a logic operation using a high-amplitude logic signal;

a transmission system having a load capacitance; and a low-voltage signal generator which is a step-down level shifter transforming an incoming high-amplitude logic signal from the first logic operation circuit to a low-amplitude logic signal having a lower amplitude than the high-amplitude logic signal for output to the transmission system.

A low-voltage signal generator in accordance with the present invention is provided in a signal processing circuit including: a first logic operation circuit which performs a logic operation using a high-amplitude logic signal; and a transmission system having a load capacitance, and characterized in that the low-voltage signal generator transforms a high-amplitude logic signal to a low-amplitude logic signal having a lower amplitude than the high-amplitude logic signal.

According to the configuration, first, the first logic operation circuit performs an operation using a high-amplitude logic signal. The output from the first logic operation circuit, that is, high-amplitude logic signal, is fed to the low-voltage signal generator which is a step-down level shifter where the high-amplitude logic signal is transformed to a low-amplitude logic signal, and the resultant low-amplitude logic signal is applied to the transmission system introducing a load capacitance.

The first logic operation circuit operates based on a high-amplitude logic signal, and is therefore free from malfunctions and operates at high speed. Further, the transmission system introducing a load capacitance operates with a low-amplitude logic signal and consumes reduced power in transmitting the output signal of the first logic operation circuit. Therefore, in the configuration including a logic operation unit which requires a high-amplitude logic signal, the present invention provides means to restrain increases in electric power consumption and occurrence of unnecessary radiation. The present invention offers: a signal processing circuit including a logic operation unit which depends on a high-amplitude logic signal for operation and a transmission system which preferably operates based on a low-amplitude logic signal to reduce electric power consumption; and a low-voltage signal generator which is a step-down level shifter capable of producing a low-amplitude logic signal from a high-amplitude logic signal.

Thus, electric power consumption is reduced in a transmission system, by producing a low-voltage signal from a high voltage signal which is required by a first circuit and transmitting it to a second circuit. The present invention hence offers a polysilicon-TFT-based circuit configuration in which both a logic operation unit which requires a high-amplitude logic signal and a transmission system having a load capacitance which requires a low-amplitude logic signal to reduce electric power consumption and also offers a step-down level shifter which serves as a low-voltage signal generator producing a low-amplitude logic signal from a high-amplitude logic signal.

The second logic operation circuit connected to the transmission system may be a circuit performing a logic operation based on a low-amplitude logic signal or a high-amplitude logic signal. For example, the logic operation circuit built around a silicon thin film transistor made of polysilicon should be driven by means of a high-amplitude logic signal if the circuit is required to handle high-speed processing, but may be sufficiently driven by means of a low-amplitude logic signal if it is required to handle only low-speed processing. The foregoing configuration in which is there provided a step-down level shifter between a first logic operation circuit and a transmission system is capable of better restraining increases in electric power consumption and occurrence of unnecessary radiation than a configuration in which is there provided a step-down level shifter between a transmission system and a second logic operation circuit.

If the second logic operation circuit performs a logic operation based on a high-amplitude logic signal, there is provided between the transmission system and the second logic operation circuit a step-up level shifter which transforms an incoming low-amplitude logic signal from the transmission system to a high-amplitude logic signal having a higher amplitude than the low-amplitude logic signal for output to the second logic operation circuit. Thus, the second logic operation circuit also operates based on a high-amplitude logic signal, and is therefore free from malfunctions and operates at high speed. The high-amplitude logic signal used in the first logic operation circuit may have the same or a different amplitude from that of the high-amplitude logic signal used in the second logic operation circuit.

Meanwhile, if the second logic operation circuit performs a logic operation based on a low-amplitude logic signal, there is no need to provide a step-up level shifter between the transmission system and the second logic operation circuit, resulting in space savings in the circuit.

An image display in accordance with the present invention includes: pixels arranged in a matrix; data signal lines each provided for a different column of pixels; scan signal lines each provided for a different row of pixels; a data signal line drive circuit driving the data signal lines; and a scan signal line drive circuit driving the scan signal lines, and is characterized in that either one, or both, of the data signal line drive circuit and the scan signal line drive circuit include(s): a first logic operation circuit which performs a logic operation using a high-amplitude logic signal; a transmission system having a load capacitance; and a low-voltage signal generator which is a step-down level shifter transforming an incoming high-amplitude logic signal from the first logic operation circuit to a low-amplitude logic signal having a lower amplitude than the high-amplitude logic signal for output to the transmission system.

According to the configuration, either the data signal line drive circuit or the scan signal line drive circuit, or both, include(s) a low-voltage signal generator thus configured.

Therefore, for example, a circuit which divides an incoming clock signal in terms of frequency as the first logic operation circuit operates based on a high-amplitude logic signal, and is hence free from malfunctions and operates at high speed. Further, the transmission system introducing a load capacitance operates based on a low-amplitude logic signal and therefore consumes reduced power in transmitting the output signal of the first logic operation circuit. The present invention thereby achieves high-speed logic operation capability and reduced electric power consumption with an image display.

For a fuller understanding of the nature and advantages of the invention, reference should be made to the ensuing detailed description taken in conjunction with the accompanying drawings.

DESCRIPTION OF THE EMBODIMENTS

Embodiment 1

Referring to FIGS. 1-22, the following will discuss an embodiment of the present invention.

The present invention is applicable to a wide range of polysilicon-based circuits. In the following, a preferred embodiment is described in which the invention is applied to an image display with a two-phase shift register. Further, a liquid crystal display is taken as an exemplary image display.

A multiphase shift register, such as a two-phase shift register, is used to perform low-speed, parallel drive when the drive frequency is so high that a single-phase shift register cannot handle.

Figure 2:
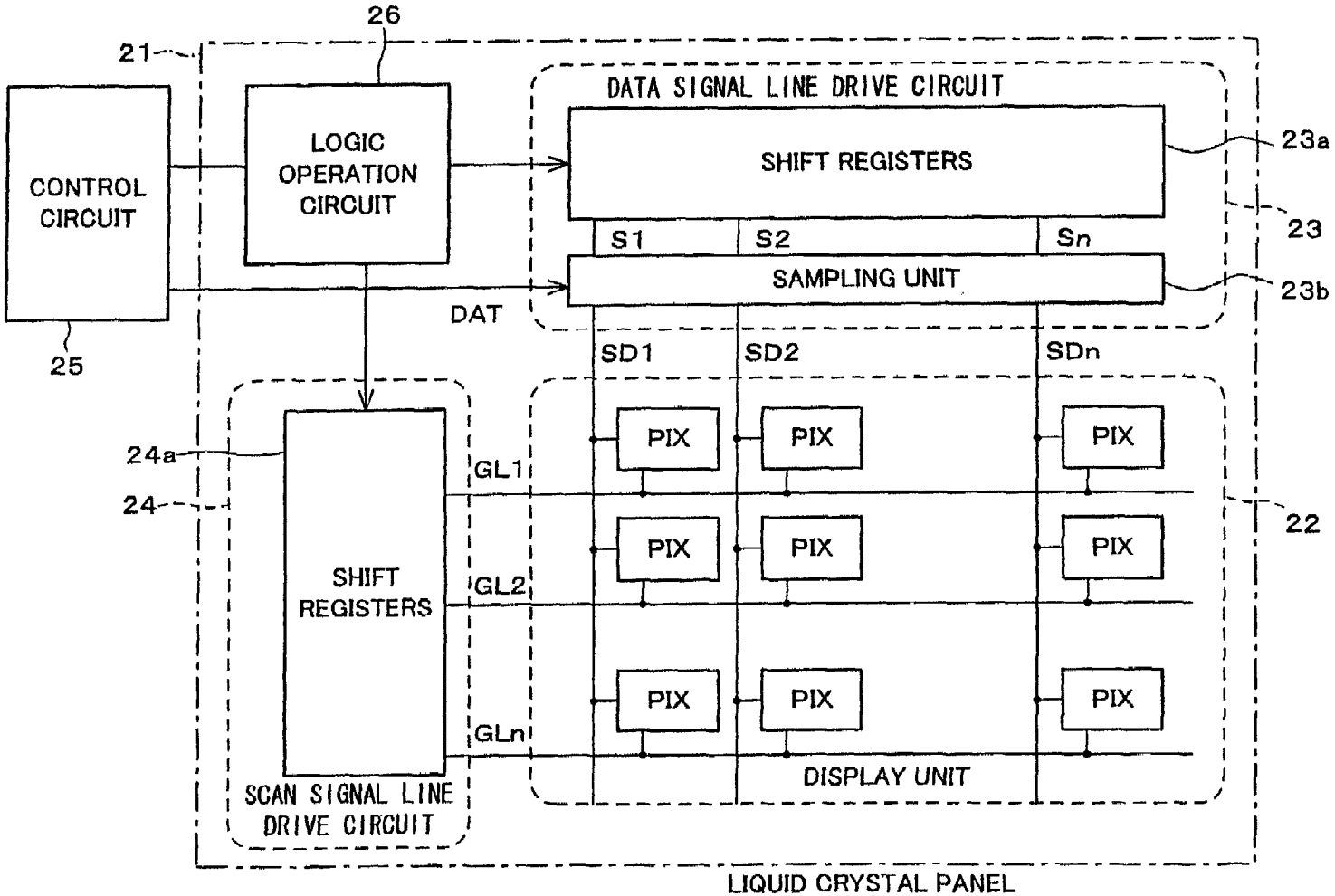
FIG. 2 is a block diagram showing as an example a configuration of a monolithic active matrix image display.

FIG. 2 shows a basic image display in its entirety. The image display includes a liquid crystal panel 21 and a control circuit 25. The liquid crystal panel 21, as a display panel, includes: a display unit 22 provided with pixels PIXs arranged in a matrix; a data signal line drive circuit 23; a scan signal line drive circuit 24; and a logic operation circuit 26. The control circuit 25 controls the circuits. The data signal line drive circuit 23 and the scan signal line drive circuit 24 have respective shift registers (23*a*, 24*a*). The data signal line drive circuit 23 has also a sampling unit 23*b*.

Figure 1:
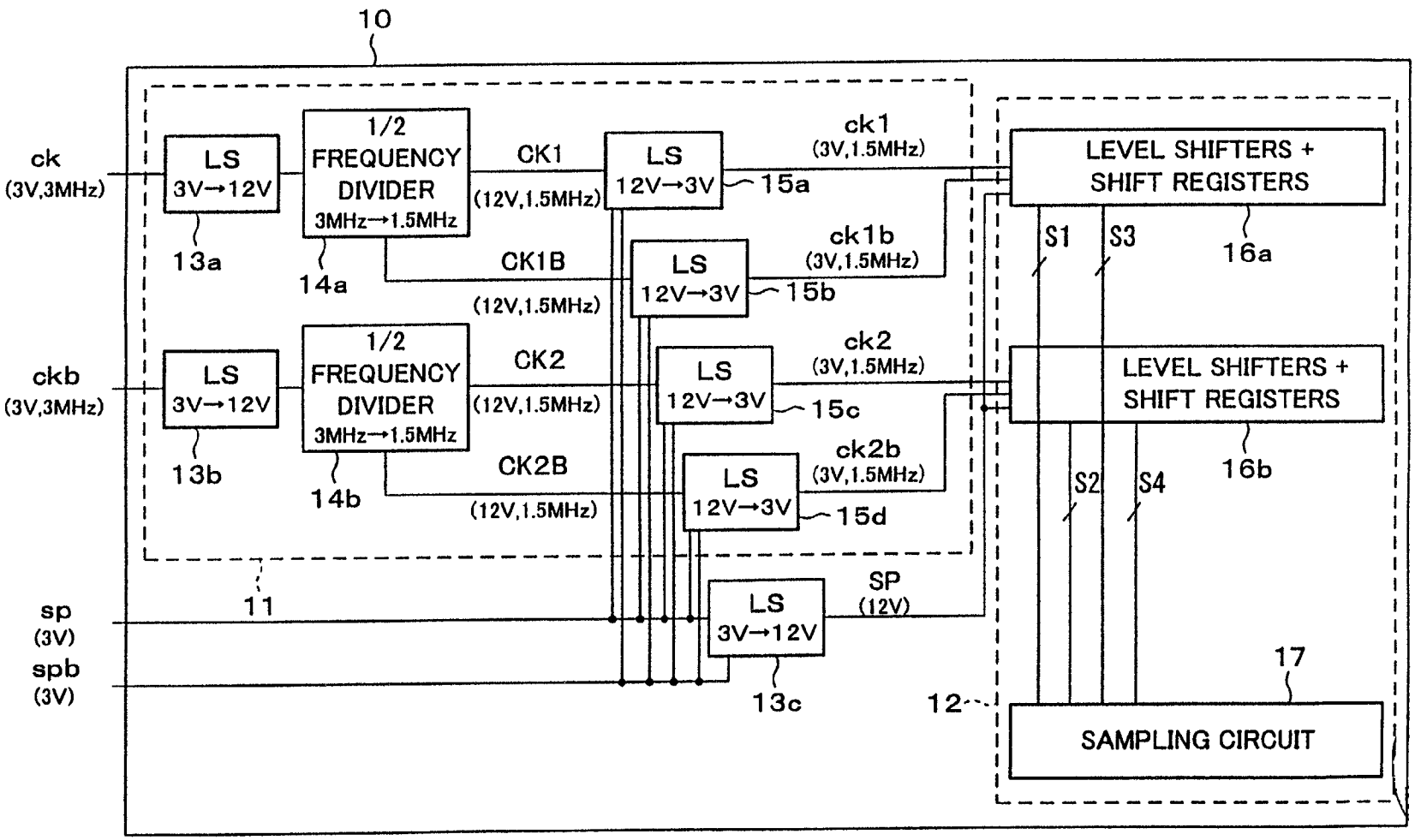
FIG. 1, in reference to an embodiment of the present invention, is a block diagram showing as an example a configuration of a data signal line drive circuit in an active matrix image display of a two-phase shift register type with low-voltage signal generators.

FIG. 1 shows the data signal line drive circuit in FIG. 2 in more detail. A liquid crystal panel 10, which is a display panel in the image display and an equivalent to the liquid crystal panel 21 in FIG. 2, is constituted by a logic operation circuit 11 (an equivalent to the circuit 26 in FIG. 2), provided in an interface unit of the panel for external control circuits, for dividing the frequency of a clock signal, and a data signal line drive circuit 12 (an equivalent to the circuit 23 in FIG. 2) including a sampling circuit 17 and shift registers 16*a*, 16*b* as two-phase shift registers in which level shifters are distributed in stages. From FIG. 1 are omitted the display unit and the scan signal line drive circuit.

The logic operation circuit 11 and the data signal line drive circuit 12, as well as the display unit and the scan signal line drive circuit which are omitted from the figure, are provided on the same substrate to cut down on the labor in manufacture and reduce wire capacitance. To accommodate more integrated pixels and increase the display area, the drive circuits and the logic operation circuits are all fabricated from silicon thin film transistors made of polysilicon formed on a glass substrate. The silicon transistors made of polysilicon are fabricated at a process temperature lower than or equal to 600° C. so that the use of an ordinary glass substrate, which has a deformation temperature of 600° C. or lower, would not lead to curvature or bending due to processing at temperatures higher than or equal to the deformation temperature.

The circuit fabricated from silicon thin film transistors made of polysilicon has a drive potential specified to, for example, about 12 V. Meanwhile, referring to FIG. 2, the control circuit 25 is formed from monocrystalline silicon transistors on a different substrate from the circuits 22-24 and 26 and has a drive potential specified to a value lower than the drive potential of the polysilicon circuit: for example, 3 V or less.

Now, the operation will be described. A 3-V, 3-MHz clock signal ck and its complementary, inverse clock signal ckb both produced in the control circuit are stepped up to 12 V by step-up level shifters 13*a*, 13*b* in the liquid crystal panel 10 in FIG. 1. Each signal is divided into two complementary signals at half its frequency. Specifically, a ½ frequency divider 14*a* divides the clock signal ck to produce a 12-V, 1.5-MHz clock signal CK1 and its complementary, inverse clock signal CK1B. Likewise, a ½ frequency divider 14*b* divides the inverse clock signal ckb to produce a 12-V, 1.5-MHz clock signal CK2 and its complementary, inverse clock signal CK2B.

A start pulse signal sp and its complementary, inverse start pulse signal spb, both supplied from the external control circuit 25 for use in a data signal line drive circuit, are stepped up to 12 V by a step-up level shifter 13*c* before being fed to the shift registers 16*a*, 16*b*. The clock signals are stepped down from 12 V to 3 V by step-down level shifters 15*a*, 15*b*, 15*c*, 15*d* controlled through a start pulse signal sp and its complementary, inverse start pulse signal spb, both of which pulse signals are supplied from the external control circuit 25 for use in a data signal line drive circuit. This low-amplitude logic clock signal, as it passes through the data signal line drive circuit 12, is stepped up again to 12 V in each stage of the shift registers to represent high-amplitude logic levels required to perform logic operations and then used for pulse shifting. Thereafter, sampling pulses are produced to enable the sampling circuit 17 to sample a data signal and supply the resultant signal to a data signal line (non-display in FIG. 1) to effect a display.

Figure 3:
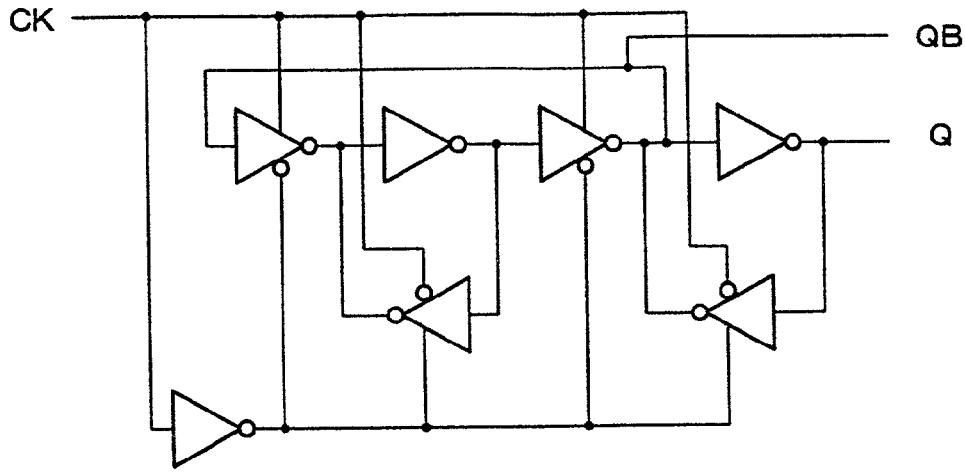
FIG. 3 is a circuit diagram showing as an example a configuration of a ½ frequency divider of a positive edge type.
Figure 4:
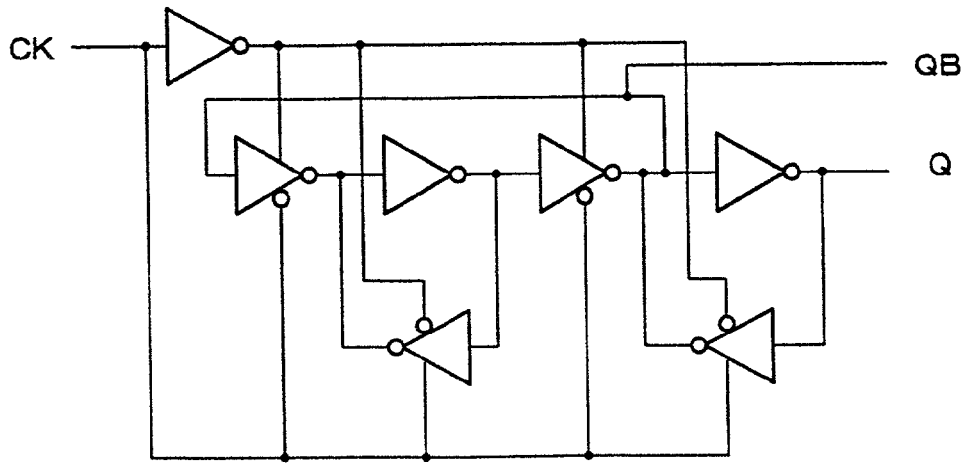
FIG. 4 is a circuit diagram showing as an example a configuration of a ½ frequency divider of a negative edge type.

FIGS. 3, 4 show, as examples, the circuit diagrams of the ½ frequency dividers 14*a*, 14*b*. With a clock signal having a frequency f being applied to the input, a clock signal and its inverse clock signal both having a frequency (½)f appear at an output Q and its complementary output QB. FIG. 3 shows a positive edge type which operates in synchronism with a leading edge of an input clock, whereas FIG. 4 shows a negative edge type which operates in synchronism with a trailing edge of an input clock.

Figure 5:
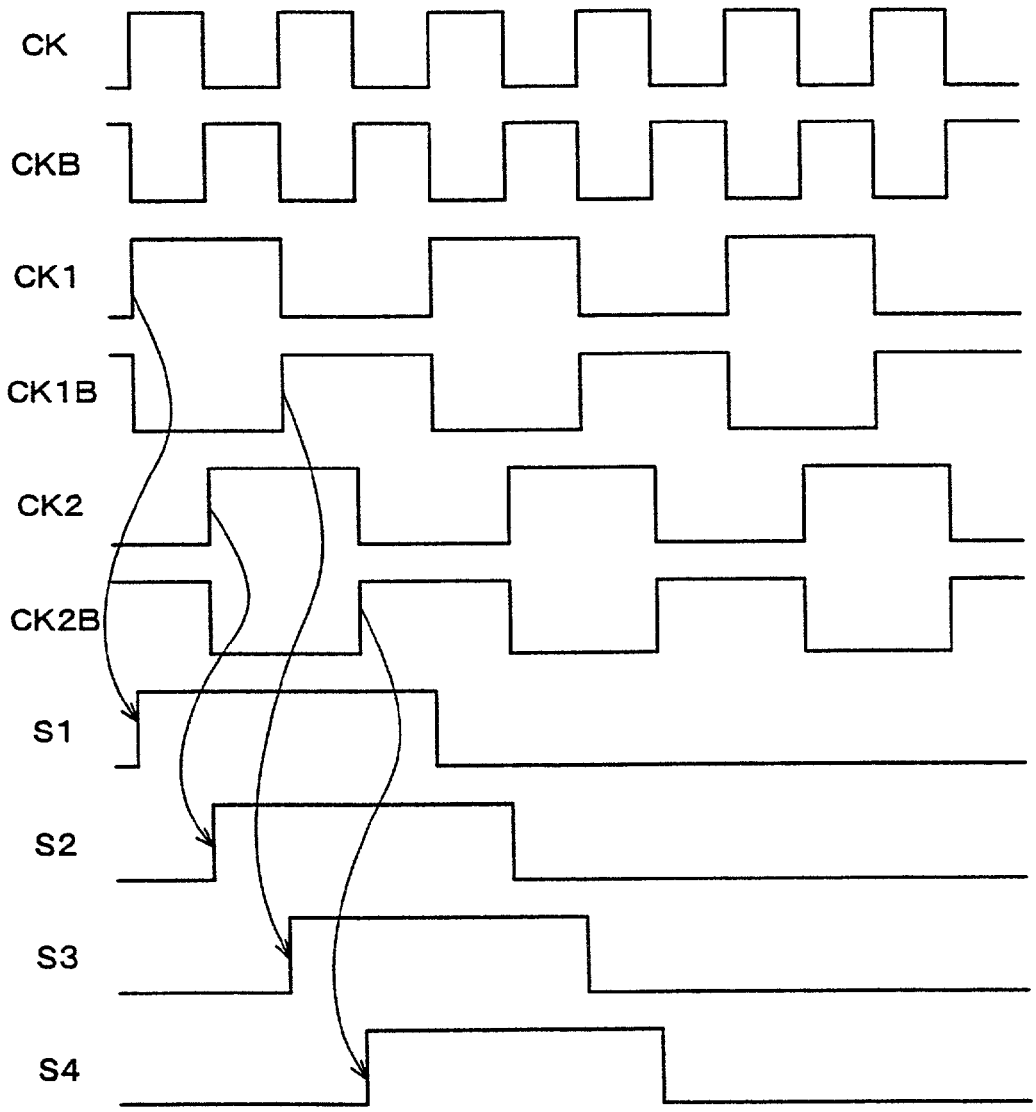
FIG. 5 is a timing chart showing operations of a ½ frequency divider and a shift register.

FIG. 5 is a signal timing diagram of the data signal line drive circuit. A positive edge type is taken as an example for description. A positive edge type of the ½ frequency divider 14*a* produces the clock signal CK1 and its complementary, inverse clock signal CK1B in synchronism with leading edges of the clock signal CK stepped up by the level shifter 13*a*. Further, a positive edge type of the ½ frequency divider 14*b* produce the clock signal CK2 and its complementary, inverse clock signal CK2B in synchronism with leading edges of the inverse clock signal CKB stepped up by the level shifter 13*b*. The clock signals CK1, CK2 are a quarter cycle out of phase, and so are the clock signals CK1B, CK2B.

The description has dealt with a positive edge type. A similar description holds true with a negative edge type.

Thereafter, the clock signal CK1 and inverse clock signal CK1B are stepped down by the step-down level shifters 15*a*, 15*b* in FIG. 1 and stepped up by the step-up level shifter in each stage, before being fed to the shift registers 16*a*, and the clock signal CK2 and inverse clock signal CK2B are stepped down by the step-down level shifters 15*a*, 15*b* in FIG. 1 and stepped up by the step-up level shifter in each stage, before being fed to the shift registers 16*b*. A sampling pulse S1 is synchronized to a leading edge of CK1, a sampling pulse S2 to a leading edge of CK2, a sampling pulse S3 to a leading edge of CK1B, and a sampling pulse S4 to a leading edge of CK2B. Thus, a train of sampling pulses are produced which are sequentially transferred to determine data sampling timings.

Figure 6:
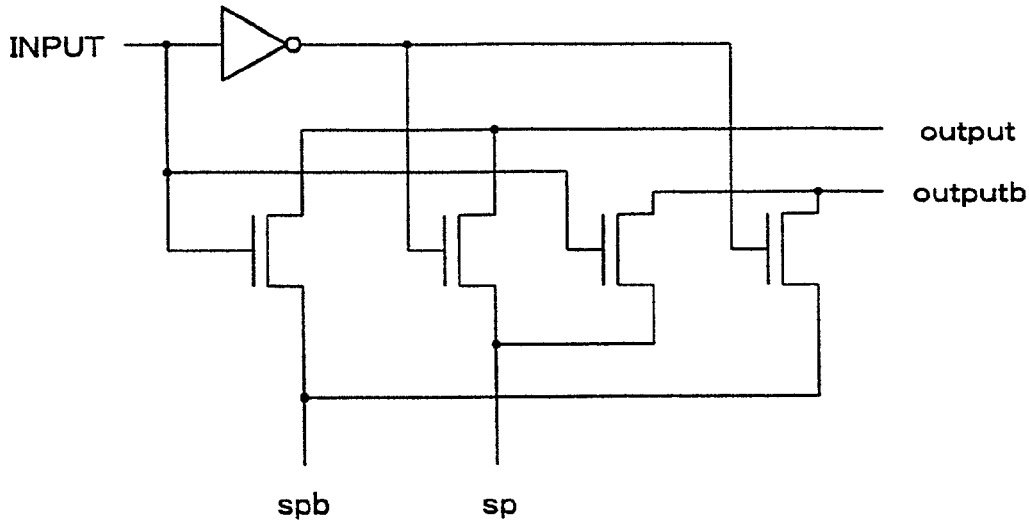
FIGS. 6-13 are circuit diagrams showing as examples the configurations of low-voltage signal generators according to the present invention.

FIG. 6 shows, as an example, a circuit diagram of a step-down level shifter which is a low-voltage signal generator usable in the present invention. In the step-down level shifter, a high-amplitude logic clock signal, applied at an input (INPUT), is coupled to the gate. The step-down level shifter is constituted by an inverter and four transistors. Either the start pulse signal sp or the inverse start pulse signal spb, which are low-amplitude logic signals, is coupled to the source of each transistor. The start pulse signal sp remains low at the potential Vss throughout most of each gate scan period, whereas the inverse start pulse signal spb remains high at the potential Vhh throughout most of each gate scan period. Vhh is a direct output of the external control circuit 25 and thus equal to a high level of a low voltage amplitude: namely, 3 V in the foregoing case described in reference to FIG. 1. As being turned on/off by means of the 12-V high-amplitude logic signal, the transistors pass either the inverse start pulse signal spb with the high potential Vhh applied to the sources or the start pulse signal sp with the low potential Vss applied to the sources. The step-down level shifter produces an output and its inverse output, one being a complementary of the other.

The configuration does not require a separate power source which supplies a high voltage of a low-amplitude logic signal to drive the step-down level shifter and allows the external control circuit 25 and the liquid crystal panel to have less interface terminals. Although a start pulse and its inverse start pulse have been used in the example above, other low-amplitude logic signals may be used instead. The step-down level shifter which is a low-voltage signal generator usable in the present invention is configured only from N-type transistors in FIG. 6, but may be configured only from P-type transistors or from both N-type transistors and P-type transistors, an equivalent to the CMOS configuration.

Figure 14:
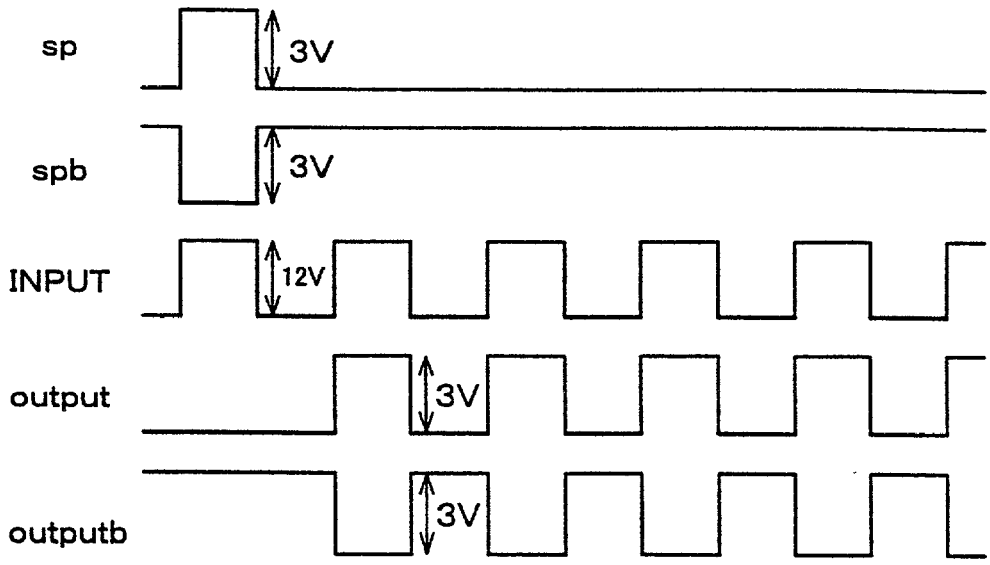
FIG. 14 being a timing chart showing operations of the low-voltage signal generator in FIG. 6.

FIG. 14 shows a timing diagram for the step-down level shifter in FIG. 6 which is a low-voltage signal generator. The start pulse signal sp and its inverse start pulse signal spb, both for use in a data signal line drive circuit, are represented by the high potential Vhh and the low potential Vss, forming a 3-V (=Vhh−Vss) pulse. Meanwhile, the input, which is a result of a logic operation to halve the frequency, switches between the high potential Vdd and the low potential Vss and has an amplitude of 12 V (=Vdd−Vss). As being turned on/off by means of that high-amplitude logic signal, the step-down level shifter produces a clock signal and an inverse clock signal of 3 V (=Vhh−Vss) having the high potential Vhh and the low potential Vss.

Figure 7:
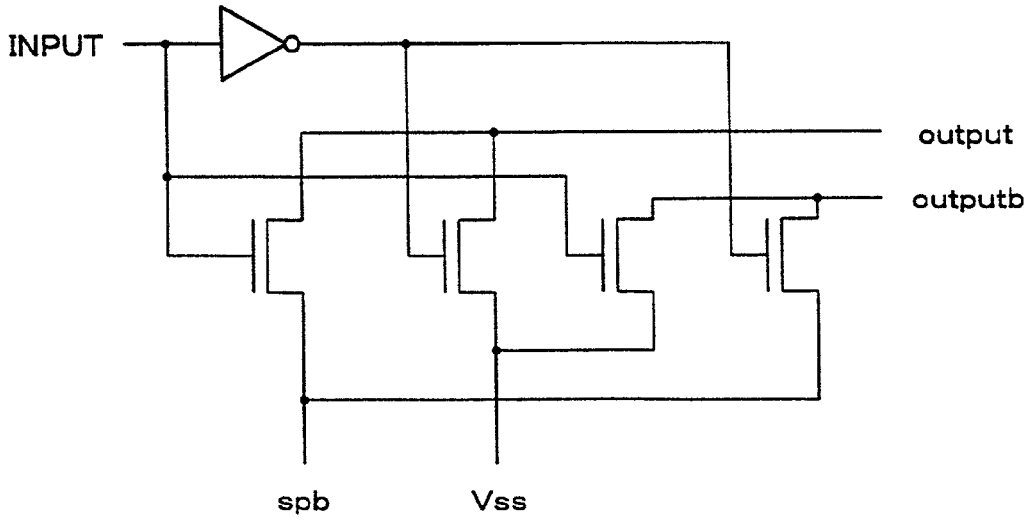

FIG. 7 shows, as an example, a circuit diagram of a step-down level shifter which is a low-voltage signal generator usable in the present invention. In the step-down level shifter, a high-amplitude logic clock signal, applied at an input (INPUT), is coupled to the gate. The step-down level shifter is constituted by an inverter and four transistors. Either the inverse start pulse signal spb, which is a low-amplitude logic signal, or the source potential Vss, providing a low level for the high- and low-amplitude logic signals, is coupled to the source of each transistor. The inverse start pulse signal spb remains high at the potential Vhh throughout most of each gate scan period. Vhh is a direct output of the external control circuit 25 and thus equal to a high level of a low voltage amplitude: namely, 3 V in the foregoing case described in reference to FIG. 1. As being turned on/off by means of the 12-V high-amplitude logic signal, the transistors pass either the inverse start pulse signal spb with the high potential Vhh applied to the sources or the high- and low-amplitude logic signals with the low potential Vss applied to the sources.

The configuration does not require a separate power source which supplies a high voltage of a low-amplitude logic signal to drive the step-down level shifter and allows the external control circuit 25 and the liquid crystal panel to have less interface terminals. Although an inverse start pulse has been used in the example above, other low-amplitude logic signals may be used instead. The step-down level shifter which is a low-voltage signal generator usable in the present invention is configured only from N-type transistors in FIG. 7, but may be configured only from P-type transistors or from both N-type transistor and P-type transistors, an equivalent to the CMOS configuration.

Figure 15:
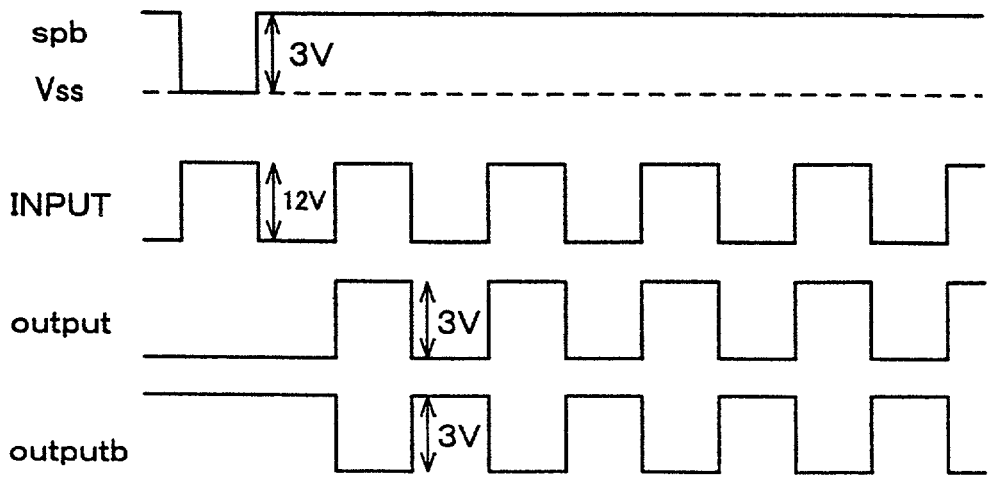
FIG. 15 being a timing chart showing operations of the low-voltage signal generator in FIG. 7.

FIG. 15 shows a timing diagram for the step-down level shifter in FIG. 7 which is a low-voltage signal generator. The inverse start pulse signal spb is represented by the high potential Vhh and the low potential Vss, forming a 3-V (=Vhh−Vss) pulse. Meanwhile, the input, which is a result of a logic operation to halve the frequency, switches between the high potential Vdd and the low potential Vss and has an amplitude of 12 V (=Vdd−Vss). As being turned on/off by means of that high-amplitude logic signal, the step-down level shifter produces a clock signal and an inverse clock signal of 3 V (=Vhh−Vss) having the high potential Vhh and the low potential Vss.

Figure 8:
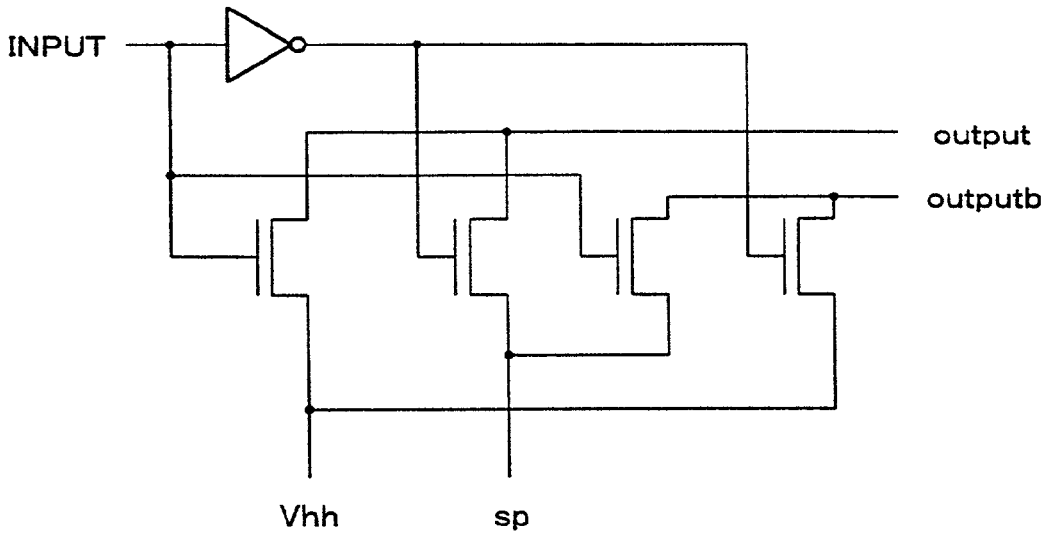

FIG. 8 shows, as an example, a circuit diagram of a step-down level shifter which is a low-voltage signal generator usable in the present invention. In the step-down level shifter, a high-amplitude logic clock signal, applied at an input (INPUT), is coupled to the gate. The step-down level shifter is constituted by an inverter and four transistors. Either the start pulse signal sp, which is a low-amplitude logic signal, or the source potential Vhh, which is a high level of a low-amplitude logic signal, is coupled to the source of each transistor. The start pulse signal sp remains low at the potential Vss throughout most of each gate scan period. Vhh is a direct output of the external control circuit 25 and thus equal to 3 V in the foregoing case described in reference to FIG. 1. As being turned on/off by means of a 12-V high-amplitude logic signal, the transistors pass either the start pulse signal sp with the low potential Vss applied to the sources or the low-amplitude logic signal with the high potential Vhh applied to the sources.

Although a start pulse has been used in the example above, other low-amplitude logic signals may be used instead. The step-down level shifter which is a low-voltage signal generator is configured only from N-type transistors in FIG. 8, but may be configured only from P-type transistors or from both N-type transistors and P-type transistors, an equivalent to the CMOS configuration.

Figure 16:
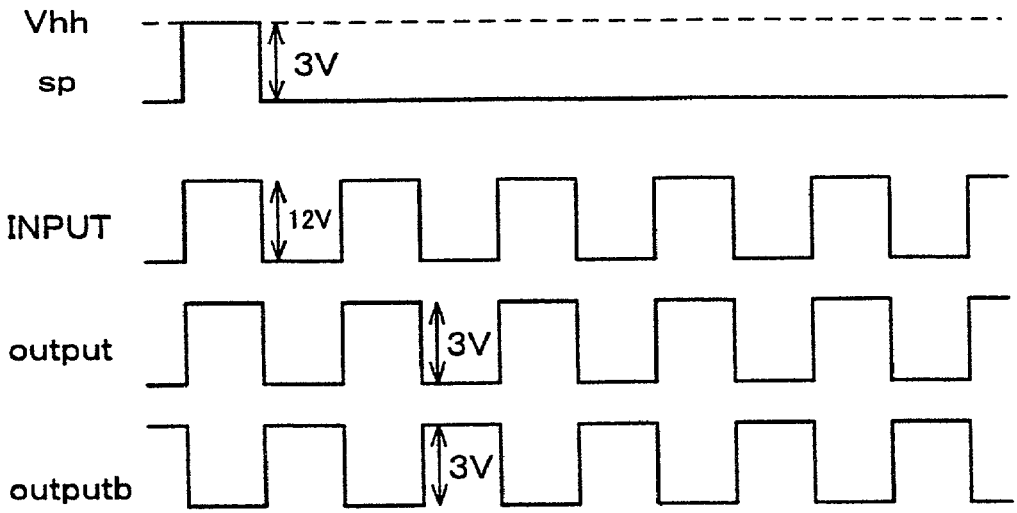
FIG. 16 being a timing chart showing operations of the low-voltage signal generator in FIG. 8.

FIG. 16 shows a timing diagram for the step-down level shifter in FIG. 8 which is a low-voltage signal generator. The start pulse signal sp is represented by the high potential Vhh and the low potential Vss, forming a 3-V (=Vhh−Vss) pulse. Meanwhile, the input, which is a result of a logic operation to halve the frequency, switches between the high potential Vdd and the low potential Vss and has an amplitude of 12 V (=Vdd−Vss). As being turned on/off by means of that high-amplitude logic signal, the step-down level shifter produces a clock signal and an inverse clock signal of 3 V (=Vhh−Vss) having the high potential Vhh and the low potential Vss.

Figure 9:
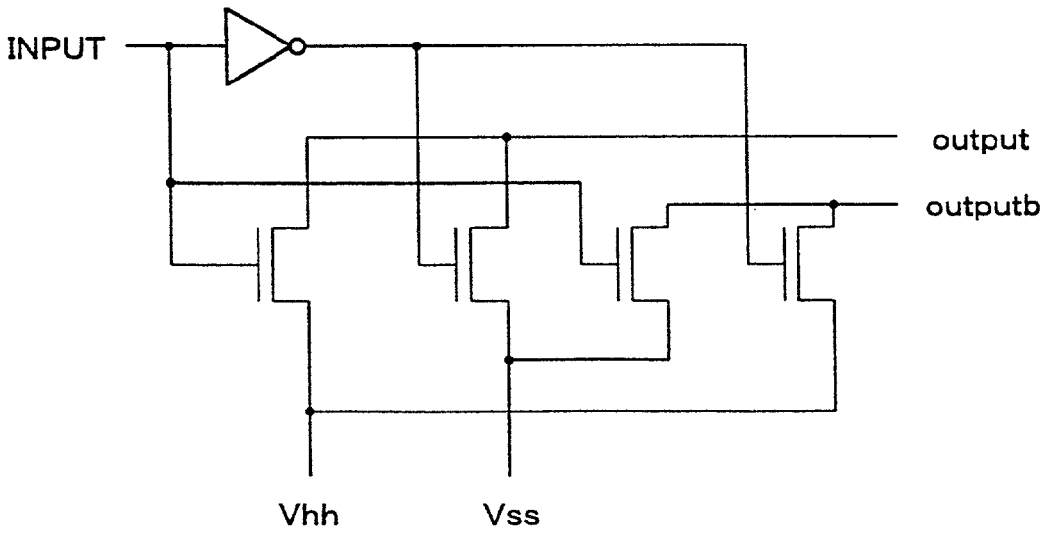

FIG. 9 shows, as an example, a circuit diagram of a step-down level shifter which is a low-voltage signal generator usable in the present invention. In the step-down level shifter, a high-amplitude logic clock signal, applied at an input (INPUT), is coupled to the gate. The step-down level shifter is constituted by an inverter and four transistors. Either the high level source potential Vhh of a low-amplitude logic signal or the low level source potential Vss of a high-amplitude logic signal and a low-amplitude logic signal is coupled to the source of each transistor. The high potential Vhh of a low-amplitude logic and the low potential Vss of the a high-amplitude logic and a low-amplitude logic are both produced by the external control circuit 25, and Vhh is equal to 3 V in the foregoing case described in reference to FIG. 1. As being turned on/off by means of a 12-V high-amplitude logic signal, the transistors pass either the low-amplitude logic signal with the high potential Vhh applied to the sources or the high- and low-amplitude logic signals with the low potential Vss.

The step-down level shifter which is a low-voltage signal generator is configured only from N-type transistors in FIG. 9, but may be configured only from P-type transistors or from both N-type transistors and P-type transistors, an equivalent to the CMOS configuration.

Figure 17:
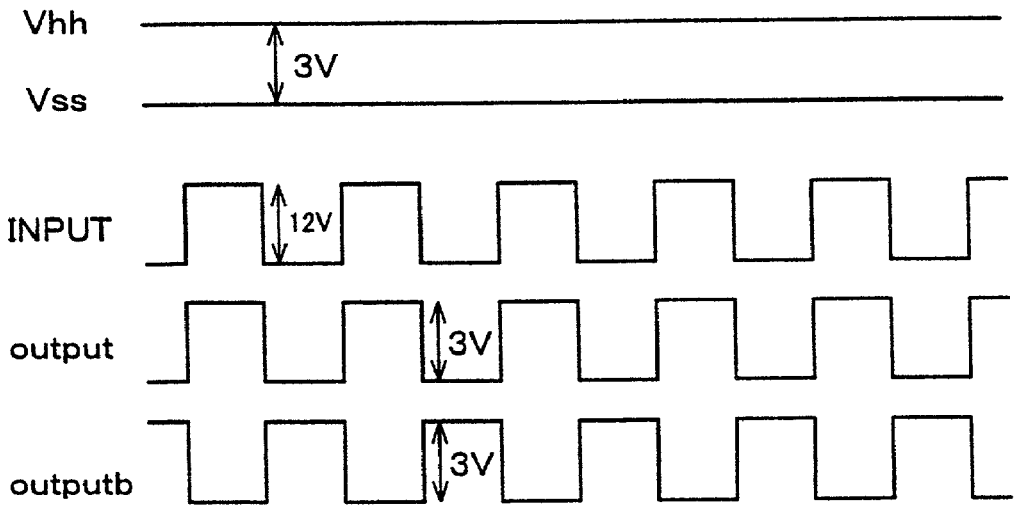
FIG. 17 being a timing chart showing operations of the low-voltage signal generator in FIG. 9.

FIG. 17 shows a timing diagram for the step-down level shifter in FIG. 9 which is a low-voltage signal generator. The high potential Vhh of a low-amplitude logic and the low potential Vss of a high-amplitude logic and a low-amplitude logic forms a voltage of 3 V (=Vhh−Vss). Meanwhile, the input, which is a result of a logic operation to halve the frequency, switches between the high potential Vdd and the low potential Vss and has an amplitude of 12 V (=Vdd−Vss). As being turned on/off by means of that high-amplitude logic signal, the step-down level shifter produces a clock signal and an inverse clock signal of 3 V (=Vhh−Vss) having the high potential Vhh and the low potential Vss.

Figure 10:
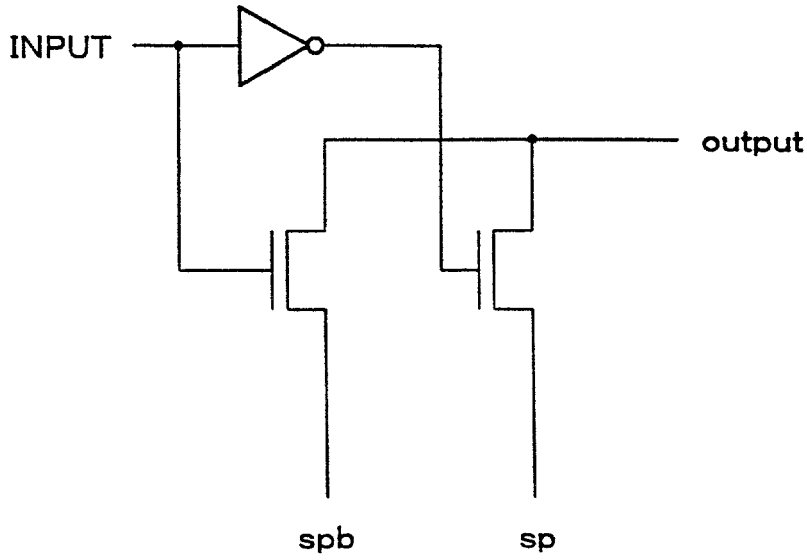

FIG. 10 shows, as an example, a circuit diagram of a step-down level shifter which is a low-voltage signal generator usable in the present invention. In the step-down level shifter, a high-amplitude logic clock signal, applied at an input (INPUT), is coupled to the gate. The step-down level shifter is constituted by an inverter two transistors. Either the start pulse signal sp or inverse start pulse signal spb, which are low-amplitude logic signals, is coupled to the source of each transistor. The start pulse signal sp remains low at the potential Vss throughout most of each gate scan period, whereas the inverse start pulse signal spb remains high at the potential Vhh throughout most of each gate scan period. Vhh is a direct output of the external control circuit 25 and thus equal to a high level of a low voltage amplitude; namely 3 V in the foregoing case described in reference to FIG. 1. As being turned on/off by means of a 12-V high-amplitude logic signal, the transistors pass either the inverse start pulse signal spb with the high potential Vhh applied to the source or the start pulse signal sp with the low potential Vss applied to the source. The step-down level shifter produces an output.

The configuration does not require a separate power source which supplies a high voltage of a low-amplitude logic signal to drive the step-down level shifter and allows the external control circuit 25 and the liquid crystal panel to have less interface terminals. Although a start pulse and an inverse start pulse have been used in the example above, other low-amplitude logic signal may be used instead. The step-down level shifter which is a low-voltage signal generator is configured only from N-type transistors in FIG. 10, but may be configured only from P-type transistors or from an N-type transistor and a P-type transistor, an equivalent to the CMOS configuration.

Figure 18:
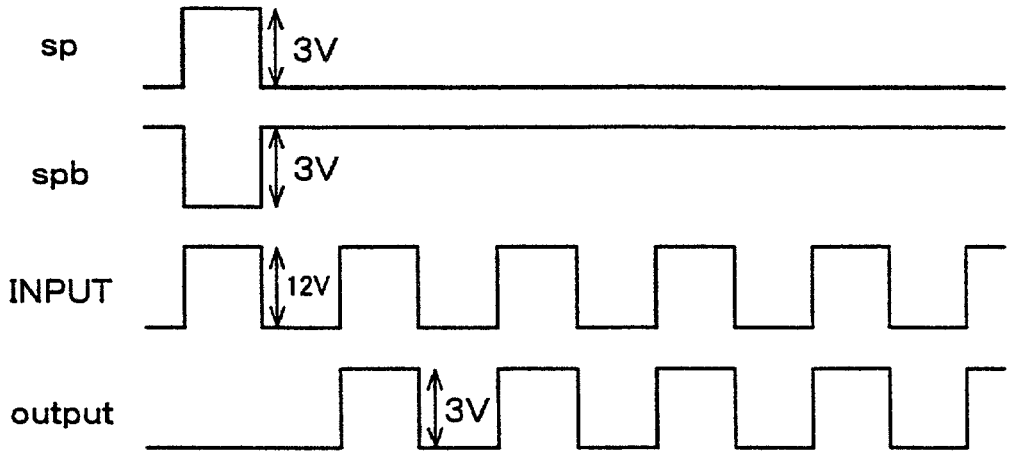
FIG. 18 being a timing chart showing operations of the low-voltage signal generator in FIG. 10.

FIG. 18 shows a timing diagram for the step-down level shifter in FIG. 10 which is a low-voltage signal generator. The start pulse signal sp and the inverse start pulse signal spb, both for use in a data signal line drive circuit, are represented by the high potential Vhh and the low potential Vss, forming a 3-V (=Vhh−Vss) pulse. Meanwhile, the input, which is a result of a logic operation to halve the frequency, switches between the high potential Vdd and the low potential Vss and has an amplitude of 12 V (=Vdd−Vss). As being turned on/off by means of that high-amplitude logic signal, the step-down level shifter produces a clock signal of 3 V (=Vhh−Vss) having the high potential Vhh and the low potential Vss.

Figure 11:
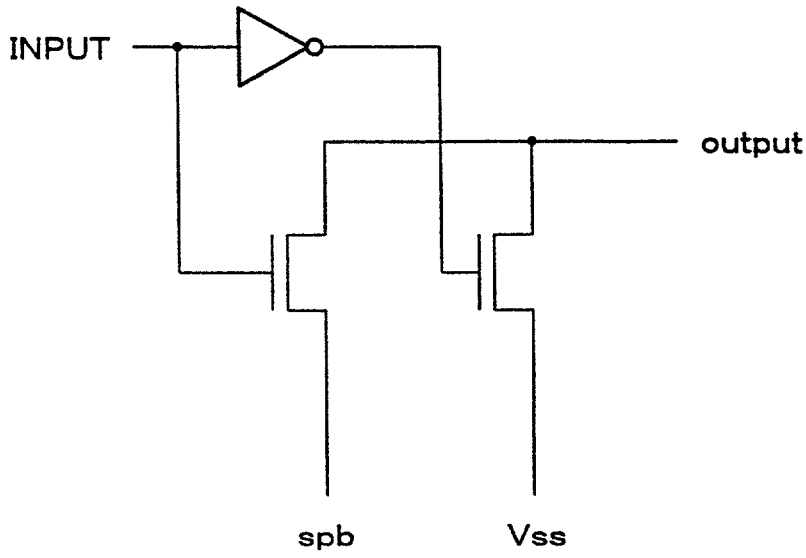

FIG. 11 shows, as an example, a circuit diagram of a step-down level shifter which is a low-voltage signal generator usable in the present invention. In the step-down level shifter, a high-amplitude logic clock signal, applied at an input (INPUT), is coupled to the gate. The step-down level shifter is constituted by an inverter and two transistors. Either the inverse start pulse signal spb, which is a low-amplitude logic signal, or the source potential Vss, which is a low level of a high-amplitude logic and a low-amplitude logic, is coupled to the source of each transistor. The inverse start pulse signal spb remains high at the potential Vhh throughout most of each gate scan period. Vhh is a direct output of the external control circuit 25 and thus equal to a high level of a low voltage amplitude; namely 3 V in the foregoing case described in reference to FIG. 1. As being turned on/off by means of a 12-V high-amplitude logic signal, the transistors pass either the inverse start pulse signal spb with the high potential Vhh applied to the source or the high- and low-amplitude logic signals with the low potential Vss applied to the source.

The configuration does not require a separate power source which supplies a high voltage of a low-amplitude logic signal to drive the step-down level shifter and allows the external control circuit 25 and the liquid crystal panel to have less interface terminals. Although an inverse start pulse has been used in the example above, other low-amplitude logic signals may be used instead. The step-down level shifter which is a low-voltage signal generator is configured only from N-type transistors in FIG. 11, but may be configured only from P-type transistors or from an N-type transistor and a P-type transistor, an equivalent to the CMOS configuration.

Figure 19:
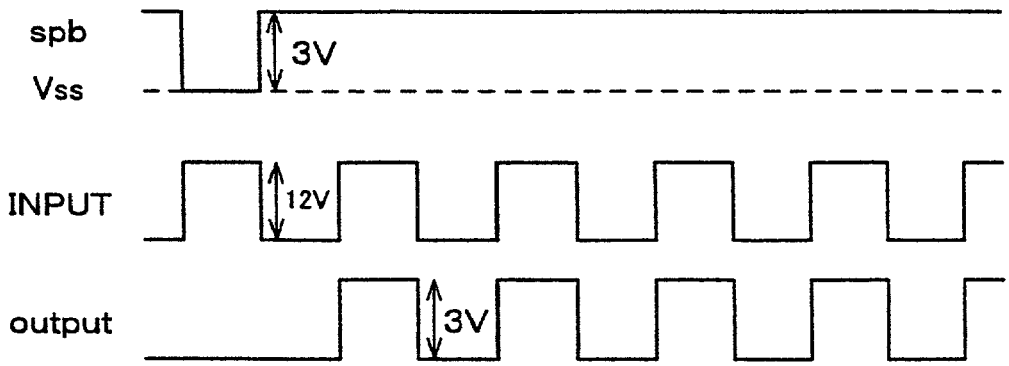
FIG. 19 being a timing chart showing operations of the low-voltage signal generator in FIG. 11.

FIG. 19 shows a timing diagram for the step-down level shifter in FIG. 11 which is a low-voltage signal generator. The inverse start pulse signal spb is represented by the high potential Vhh and the low potential Vss, forming a 3-V (=Vhh−Vss) pulse. Meanwhile, the input, which is a result of a logic operation to halve the frequency, switches between the high potential Vdd and the low potential Vss and has an amplitude of 12 V (=Vdd−Vss). As being turned on/off by means of that high-amplitude logic signal, the step-down level shifter produces a clock signal of 3 V (=Vhh−Vss) having the high potential Vhh and the low potential Vss.

Figure 12:
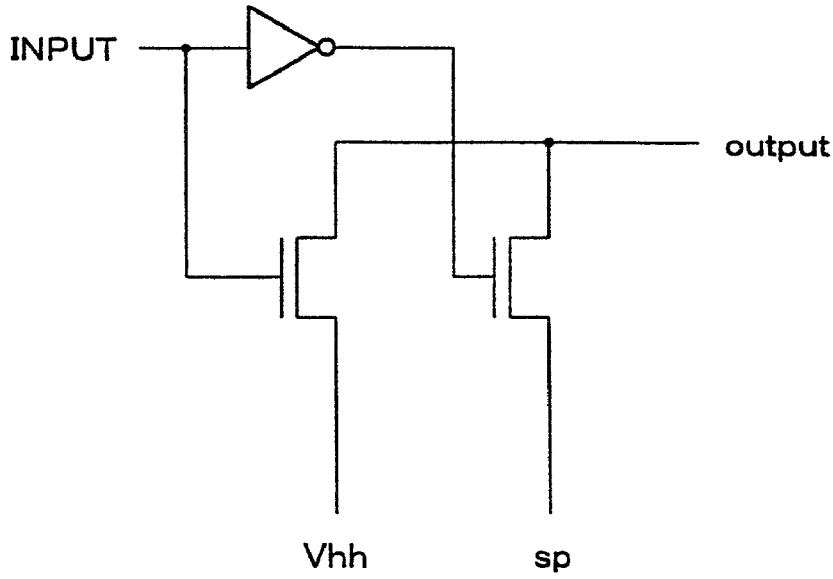

FIG. 12 shows, as an example, a circuit diagram of a step-down level shifter which is a low-voltage signal generator usable in the present invention. In the step-down level shifter, a high-amplitude logic clock signal, applied at an input (INPUT), is coupled to the gate. The step-down level shifter is constituted by an inverter and two transistors. Either the start pulse signal sp, which is a low-amplitude logic signal, or the source potential Vhh, which is a high level of a low-amplitude logic, is coupled to the source of each transistors. The start pulse signal sp remains low at the potential Vss throughout most of each gate scan period. Vhh is a direct output of the external control circuit 25 and thus equal to 3 V in the foregoing case described in reference to FIG. 1. As being turned on/off by means of a 12-V high-amplitude logic signal, the transistors pass either the start pulse signal sp with the low potential Vss applied to the source or the low-amplitude logic signal with the high potential Vhh applied to the source.

Although a start pulse has been used in the example above, other low-amplitude logic signals may be used instead. The step-down level shifter which is a low-voltage signal generator is configured only from N-type transistors in FIG. 12, but may be configured only from P-type transistors or from an N-type transistor and a P-type transistor, an equivalent of a CMOS configuration.

Figure 20:
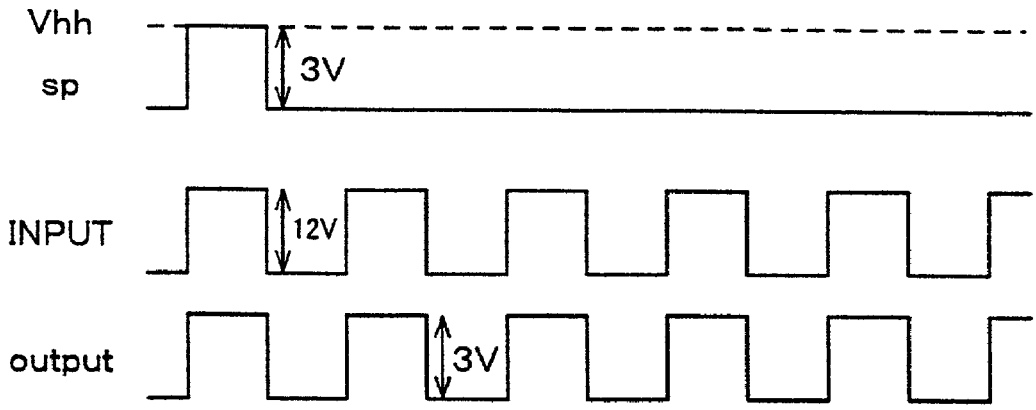
FIG. 20 being a timing chart showing operations of the low-voltage signal generator in FIG. 12.

FIG. 20 shows a timing diagram for the step-down level shifter in FIG. 12 which is a low-voltage signal generator. The start pulse signal sp is represented by the high potential Vhh and the low potential Vss, forming a 3-V (=Vhh−Vss) pulse. Meanwhile, the input, which is a result of a logic operation to halve the frequency, switches between the high potential Vdd and the low potential Vss and has an amplitude of 12 V (=Vdd−Vss). As being turned on/off by means of that high-amplitude logic signal, the step-down level shifter produces a clock signal of 3 V (=Vhh−Vss) having the high potential Vhh and the low potential Vss.

Figure 13:
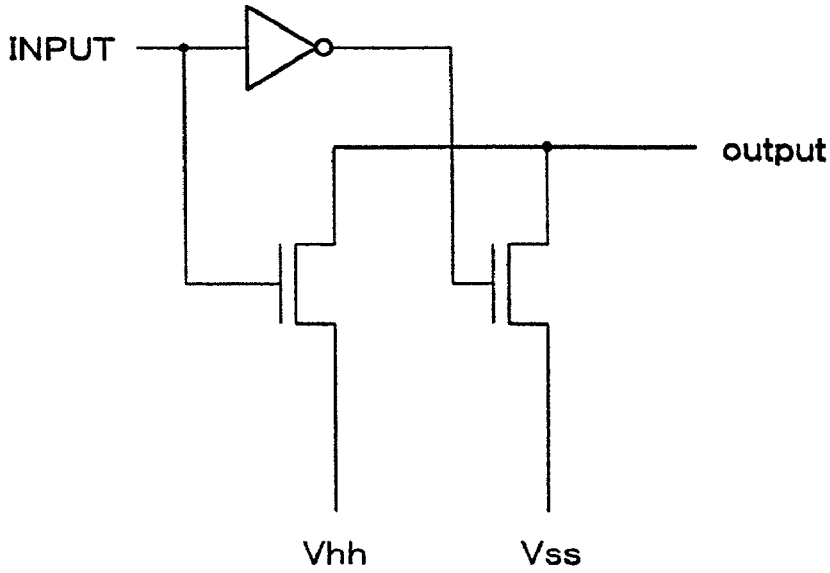

FIG. 13 shows, as an example, a circuit diagram of He a step-down level shifter which is a low-voltage signal generator usable in the present invention. In the step-down level shifter, a high-amplitude logic clock signal, applied at an input (INPUT), is coupled to the gate. The step-down level shifter is constituted by an inverter and two transistors. Either the high potential Vhh of a low-amplitude logic or the low potential Vss of a high-amplitude logic and a low-amplitude logic are coupled to the source of each transistor. The high potential Vhh of a low-amplitude logic or the low potential Vss of a high-amplitude logic and a low-amplitude logic is produced by the external control circuit 25, and Vhh is equal to 3 V in the foregoing case described in reference to FIG. 1. By being turned on/off by means of a 12-V high-amplitude logic signal, the transistors pass either the low-amplitude logic with the high potential Vhh applied to the source or the high- and low-amplitude logic signals with the low potential Vss applied to the source.

The step-down level shifter which is a low-voltage signal generator is configured only from N-type transistors in FIG. 13, but may be configured only from P-type transistors or from an N-type transistor and a P-type transistor, an equivalent to the CMOS configuration.

Figure 21:
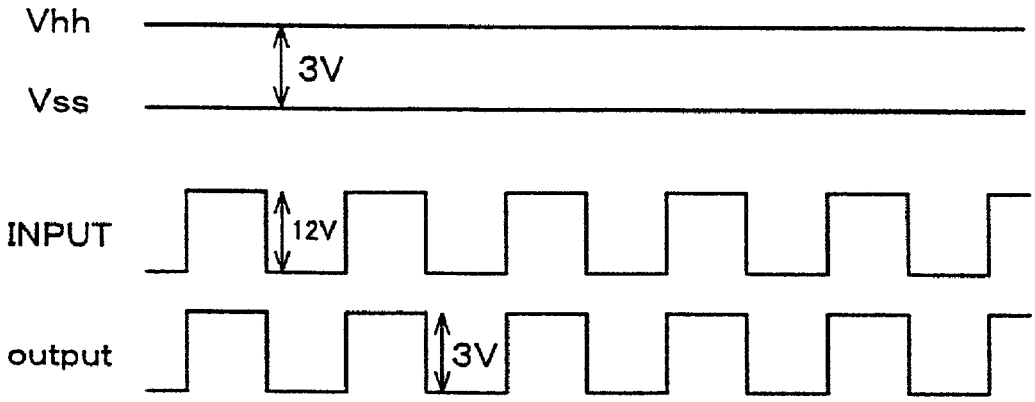
FIG. 21 being a timing chart showing operations of the low-voltage signal generator in FIG. 13.

FIG. 21 shows a timing diagram for the step-down level shifter in FIG. 13 which is a low-voltage signal generator. The high potential Vhh of a low-amplitude logic and the low potential Vss of a high-amplitude logic and a low-amplitude logic form a voltage of 3 V (=Vhh−Vss). Meanwhile, the input, which is a result of a logic operation to halve the frequency, switches between the high potential Vdd and the low potential Vss and has an amplitude of 12 V (=Vdd−Vss). By being turned on/off by means of that high-amplitude logic signal, the step-down level shifter produces a clock signal of 3 V (=Vhh−Vss) having the high potential Vhh and the low potential Vss.

The step-down level shifters in FIGS. 6-13, which are low-voltage signal generators, are mere examples and may be otherwise configured to produce a low-amplitude logic signal output from a high-amplitude logic signal.

With the present embodiment, the liquid crystal panel allows for a reduced voltage input and a reduced-voltage clock signal which passes through the data signal line drive circuit, thereby achieving reduced electric power consumption. In the example above, the voltage is lowered from 12 V to 3 V, and the electric power consumption by a clock wire is greatly reduced to 1/16. Further, lowering the voltage will lower unnecessary radiation.

The present embodiment is applicable not only to a data signal line drive circuit, but also to a scan signal line drive circuit in a liquid crystal display, and further to organic EL (OLED) and other displays.

Figure 22:
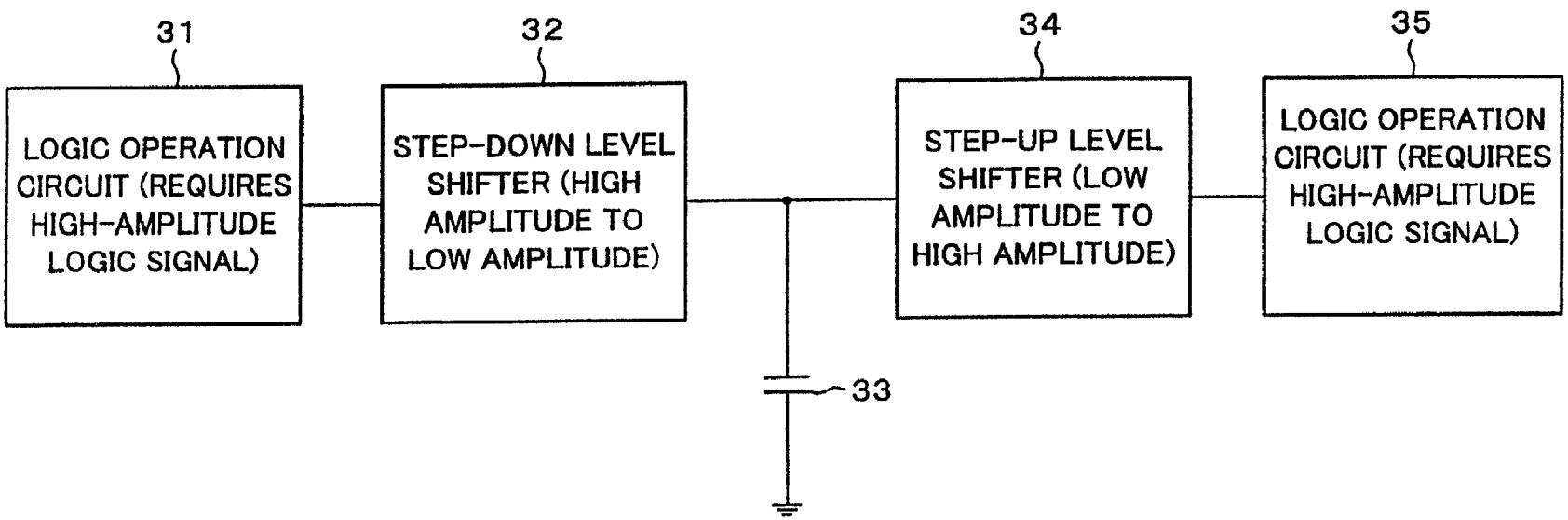
FIG. 22 is a block diagram showing a generalized concept about the circuit configuration of the present invention.

The present embodiment is intended to provide concrete examples, and FIG. 22 shows a typical one. The circuit includes logic operation circuits 31, 35 which require a high-amplitude logic signal and a transmission system 33 having a load capacitance provided between the circuits 31, 35. Further, between the logic operation circuit 31 and the transmission system 33 is there provided a step-down level shifter 32 which steps down the high-amplitude logic signal to a low-amplitude logic signal. Between the transmission system 33 and the logic operation circuit 35 is there provided a step-up level shifter 34 which steps up the low-amplitude logic signal to the high-amplitude logic signal. The circuit configuration greatly reduces the electric power consumption and unnecessary radiation, in the load capacitance wire, which is in direct proportion to the square of the voltage.

The circuit shown in FIG. 22 is applicable not only to liquid crystal displays, but also to organic EL (OLED) and other active matrix displays.

Embodiment 2

Figure 23:
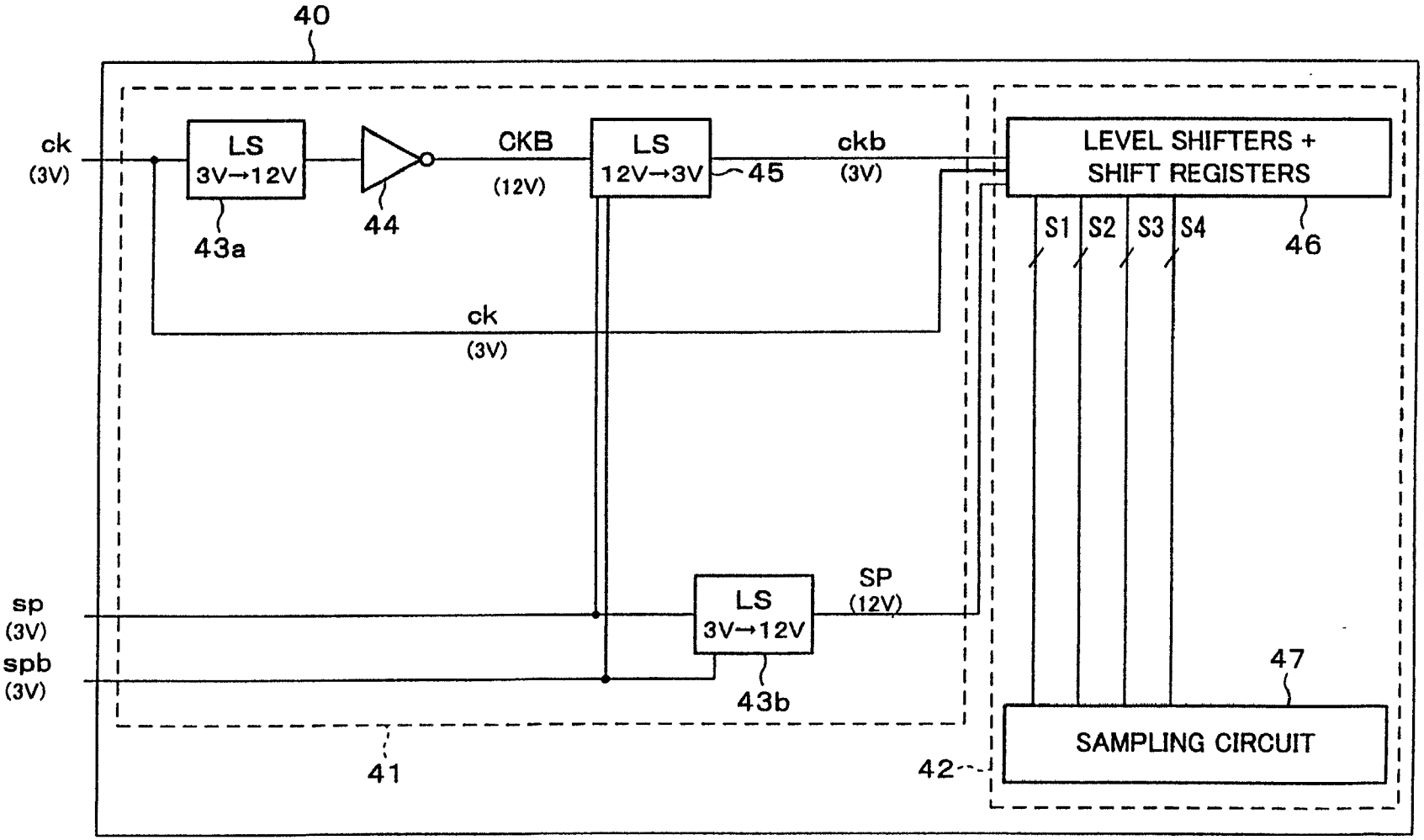
FIG. 23, in reference to another embodiment of the present invention, is a block diagram showing as an example a configuration of a data signal line drive circuit in an active matrix image display with low-voltage signal generators and an inverse clock signal generator.

Referring to FIGS. 2 and 23, the following will discuss another embodiment of the present invention. Here, for convenience, members of the present embodiment that have the same arrangement and function as members of the previous embodiment, and that are mentioned in that embodiment are indicated by the same reference numerals and description thereof is omitted.

The present invention is applicable to a wide range of polysilicon-based circuits. In the following, a preferred embodiment is described in which the invention is applied to an image display with a single-phase-clock input.

Figure 30:
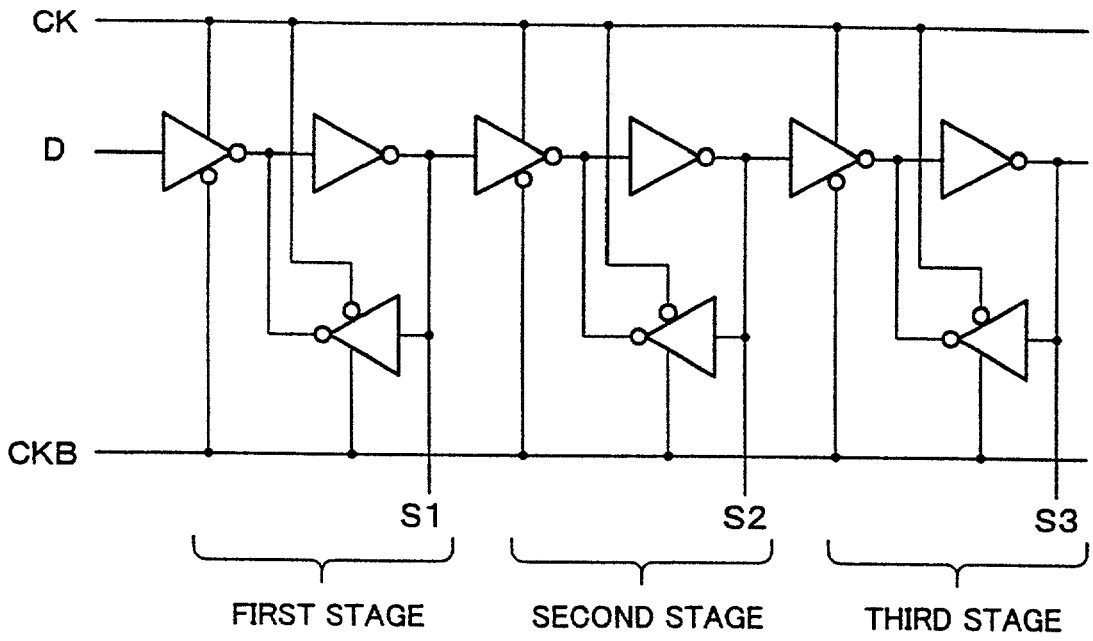
FIG. 30 is a circuit diagram showing as an example a configuration of typical shift registers constituted by D-type flip flops.
Figure 31A:
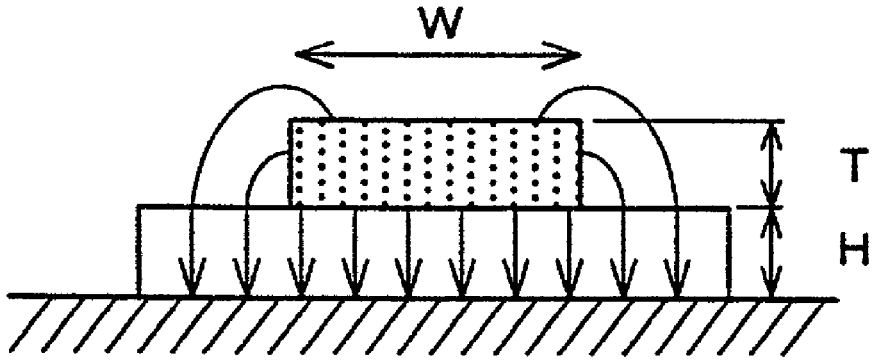
FIGS. 31(*a*), 31(*b*) are equivalent models to estimate wire's capacitance.
Figure 31B:
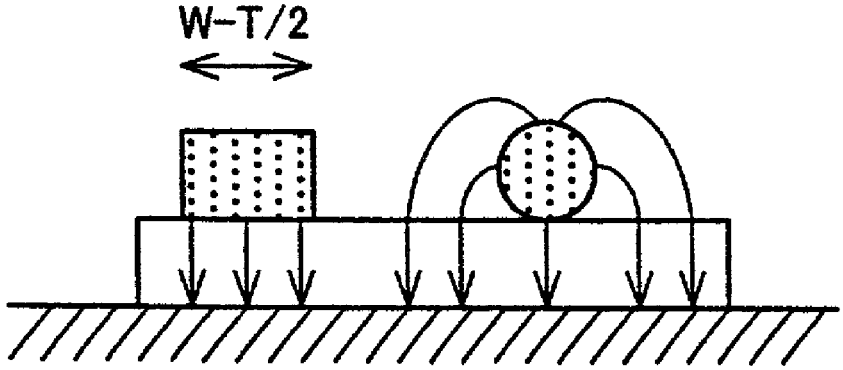
Figure 32:
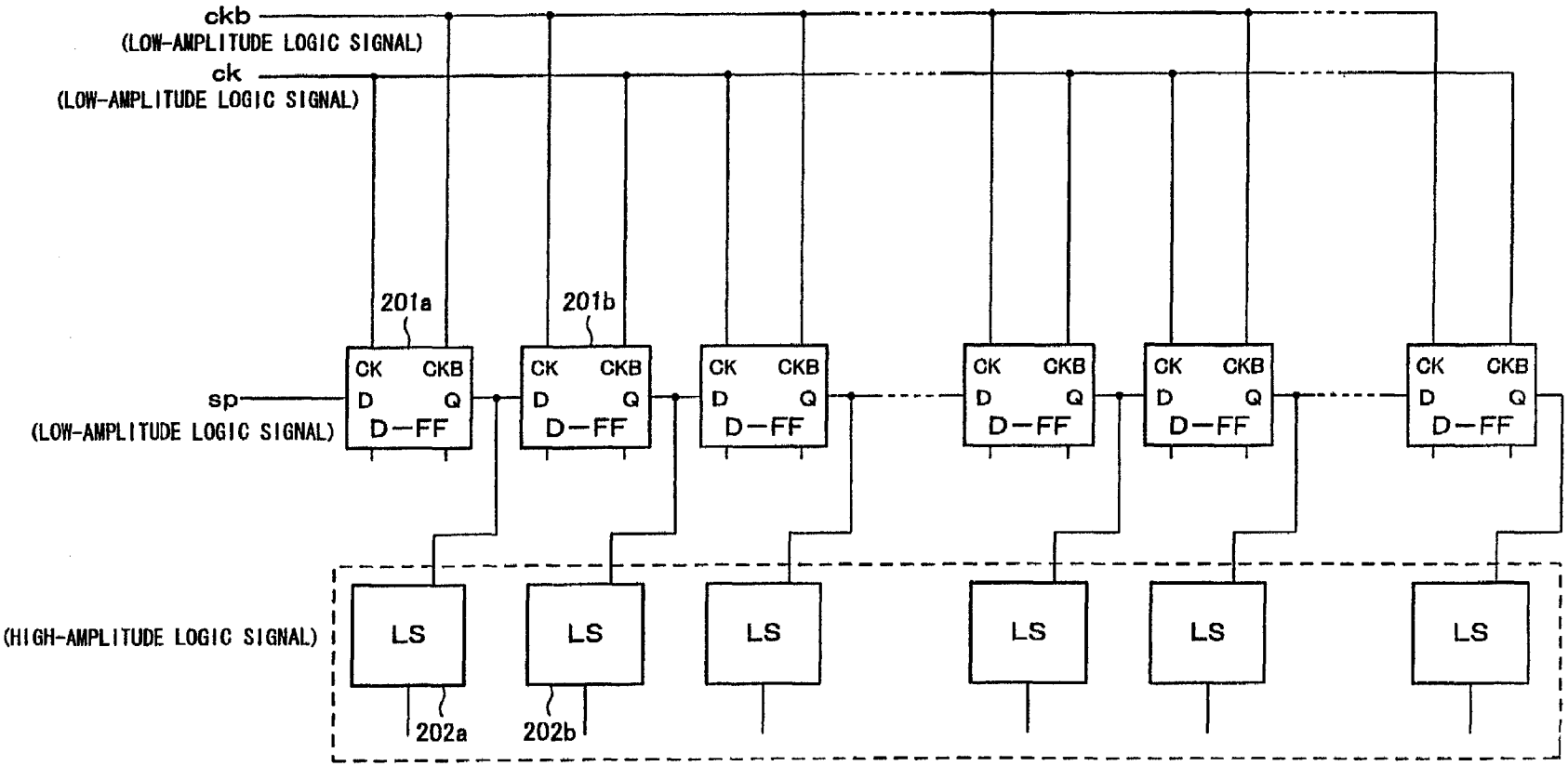
FIG. 32 is a block diagram showing as an example a configuration of conventional shift registers provided in each stage with a level shifter which steps up a low-amplitude logic signal output of a shift register.
Figure 33:
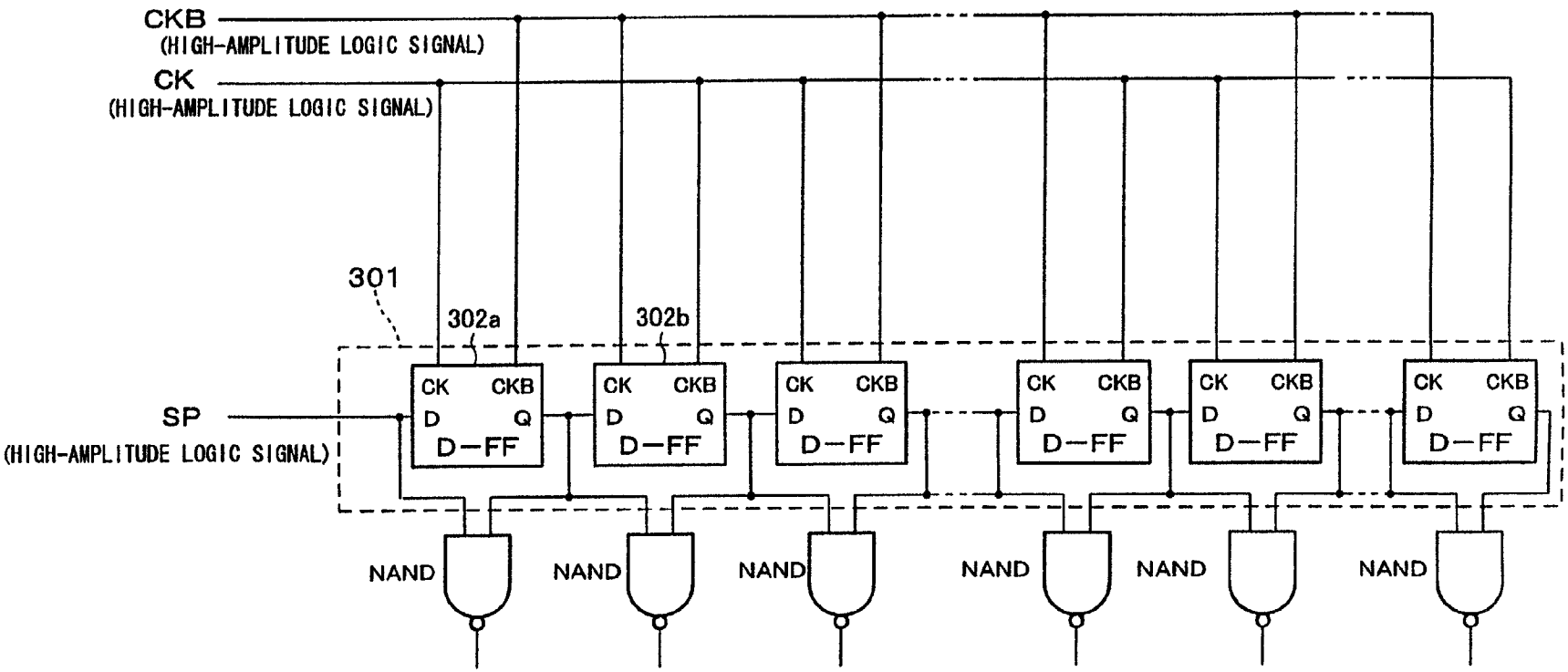
FIG. 33 is a block diagram showing as an example a configuration of typical shift registers constituted by D-type flip flops.
Figure 34:
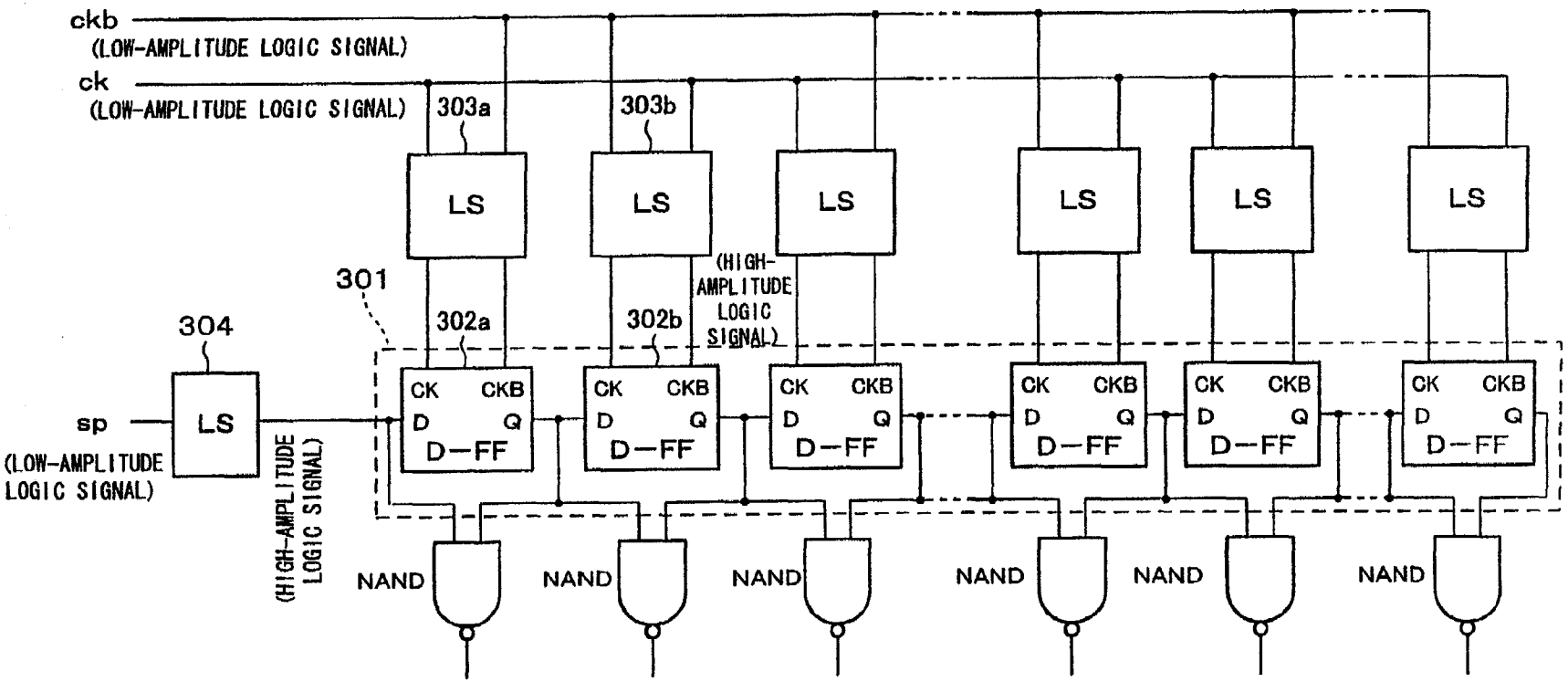
FIG. 34 is a block diagram showing as an example a configuration of conventional shift registers provided in each stage with a level shifter which steps up a low-amplitude logic signal which is a clock signal.

To drive a shift register including typical D-type flip flops as constituting elements, as shown in FIG. 30, are required a clock signal and its complementary, inverse clock signal. FIG. 23 shows a data signal line drive circuit in FIG. 2 which shows a basic image display in its entirety. Specifically, an image display 40 is configured by: a logic operation circuit 41 which produces, from an incoming clock signal from the external control circuit 25, its inverse clock signal; and a data signal line drive circuit 42 including a sampling circuit 47 and shift registers 46 with level shifters distributed so that there is one level shifter in each stage. In FIG. 23, the display unit and the scan signal line drive circuit are omitted.

The logic operation circuit 41, the data signal line drive circuit 42, as well as the display unit and the scan signal line drive circuit which are omitted from the figure, are provided on the same substrate to cut down on the labor in manufacture and reduce wire capacitance. To accommodate more integrated pixels and increase the display area, the drive circuits and logic circuit are all fabricated from polysilicon thin film transistors formed on a glass substrate. The polysilicon transistors are fabricated at a process temperature lower than or equal to 600° C. so that the use of an ordinary glass substrate, which has a deformation temperature of 600° C. or lower, would not lead to curvature or bending due to processing at temperatures higher than or equal to the deformation temperature.

The circuit fabricated from polysilicon thin film transistors has a drive potential specified, for example, to about 12 V. Meanwhile, referring to FIG. 2, the control circuit 25 is formed from monocrystalline silicon transistors on a different substrate from the circuits 22-24 and 26 and has a drive potential specified to a value lower than the drive potential of the polysilicon circuit: for example, 3 V or less.

Now, the operation will be described. A start pulse signal sp and its complementary, inverse start pulse signal spb, both supplied from the external control circuit 25 for use in data signal line drive circuit, are stepped up to 12 V by the step-up level shifter 43*b* before being fed to the shift registers 46. The 3-V clock signal ck produced by the control circuit 25 is stepped up to 12 V by the level shifter 43*a* in the liquid crystal panel 40. The stepped-up signal is inverted by the inverter 44 to produce a 12-V complementary, inverse clock signal CKB. The inverse clock signal CKB is stepped down from 12 V to 3 V by the step-down level shifter 45 which is controlled by means of the start pulse signal sp and its complementary, inverse start pulse signal spb, both supplied from the external control circuit 25 for use in the data signal line drive circuit. As the low-amplitude logic inverse clock signal Ckb and the clock signal ck which is not stepped up by the step-up level shifter 43*a* pass through the data signal line drive circuit 42, the signals are stepped up again to 12 V by each of the stages in the shift register to represent high-amplitude logic levels required to perform logic operation and then used for pulse shifting. Thereafter, sampling pulses are produced to enable the sampling circuit 47 to sample a data signal and supply the resultant signal to each of data signal lines (non-display in FIG. 23) to effect a display.

In the present embodiment, an inverse clock signal is produced in the liquid crystal panel and do not have to be fed from the outside; therefore, the interface needs less terminals.

In the present embodiment, the step-down level shifter shown in FIGS. 6-13 which is a low-voltage signal generator is used. The present embodiment may, however, be configured otherwise to produce a low-amplitude logic signal output from a high-amplitude logic signal input. The step-down level shifter which is a low-voltage signal generator operates in the same fashion as explained in embodiment 1.

With the present invention, the liquid crystal panel allows for a reduced voltage input and a reduced-voltage clock signal which passes through the data signal line drive circuit, thereby achieving reduced electric power consumption. In the example above, the voltage is lowered from 12 V to 3 V, and the electric power consumption by a clock wire is greatly reduced to 1/16. Further, lowering the voltage will lower unnecessary radiation.

The present invention is applicable not only to a data signal line drive circuit, but also to a scan line drive circuit in a liquid crystal display, and further to organic EL (OLED) and other displays.

Embodiment 3

Figure 24:
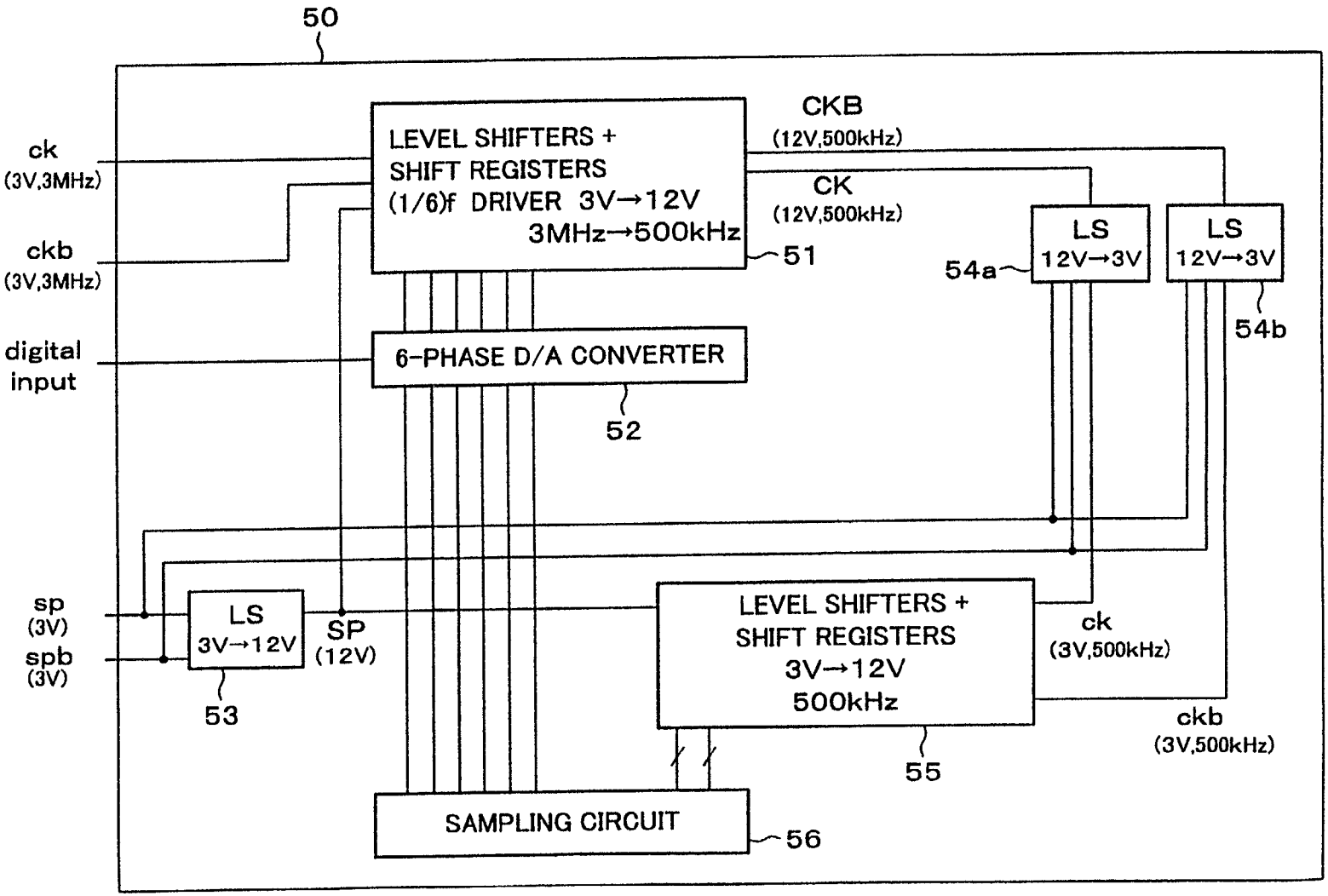
FIG. 24, in reference to another embodiment of the present invention, is a block diagram showing as an example a configuration of a digital data signal line drive circuit in an active matrix image display with a low-voltage signal generator.

Referring to FIGS. 2 and 24, the following will discuss another embodiment of the present invention. Here, for convenience, members of the present embodiment that have the same arrangement and function as members of any of the previous embodiments, and that are mentioned in that embodiment are indicated by the same reference numerals and description thereof is omitted.

The present invention is applicable to a wide range of polysilicon-based logic circuits. In the following, a preferred embodiment is described in which the invention is applied to an image display with a digital input.

FIG. 24 shows a data signal line drive circuit in a basic image display. A data signal line drive circuit 50 in an image display operates with a clock signal ck, inverse clock signal ckb, start pulse sp, inverse start pulse spb, and other control signals and a digital data input signal (digital input), all signals fed from external circuits. The data signal line drive circuit 50 is configured by: shift registers 51 in which level shifters are distributed, so as to lower the frequency of a high frequency signal to 1/6 that frequency and also to control a digital-to-analog converter (hereinafter, D/A converter); a 6-phase D/A converter 52 which simultaneously converts six signals from digital to analog; a step-up level shifter 53 which transforms a low-amplitude logic signal to a high-amplitude logic signal; step-down level shifters 54*a*, 54*b* which transform a high-amplitude logic signal to a low-amplitude logic signal; a sampling circuit 56 which samples data; and shift registers 55 in which level shifters are distributed, so as to control the sampling circuit 56. In FIG. 24, the display unit and the scan signal line drive circuit are omitted.

The data signal line drive circuit 50, as well as the display unit and the scan signal line drive circuit which are omitted from the figure, are provided on the same substrate to cut down on the labor in manufacture and reduce wire capacitance. To accommodate more integrated pixels and increase the display area, the drive circuits and logic operation circuits are all fabricated from polysilicon thin film transistors formed on a glass substrate. The polysilicon transistors are fabricated at a process temperature lower than or equal to 600° C. so that the use of an ordinary glass substrate, which has a deformation temperature of 600° C. or lower, would not lead to curvature or bending due to processing at temperatures higher than or equal to the deformation temperature.

The circuit fabricated from polysilicon thin film transistors has a drive potential specified, for example, to about 12 V. Meanwhile, referring to FIG. 2, the control circuit 25 is formed from monocrystalline silicon transistors on a different substrate from the data signal line drive circuit, the display unit, and the scan signal line drive circuit and has a drive potential specified to a value lower than the drive potential of the polysilicon circuit: for example, 3 V or less.

Now, the operation will be described. A 3-V, start pulse signal sp and its inverse start pulse signal spb, which are low-amplitude logic signals supplied from an external control circuit 25, are fed to the step-up level shifter 53 where a 12-V start pulse signal SP, which is a high-amplitude logic signal, is produced. The 12-V start pulse signal SP, as well as a 3-V clock signal ck and its inverse clock signal ckb which are low-amplitude logic signals supplied from the external control circuit 25, are fed to the shift registers 51 with level shifters distributed so that there is one level shifter in each stage. The start pulse signal SP triggers the operation of the shift registers 51. The clock signal ck and the inverse clock signal ckb, which are low-amplitude logic signals, are stepped up to 12 V by the level shifters in the stages for use in driving shift registers. The shift registers operate at 3 MHz; however, the frequency is reduced to 500 kHz to produce an output of a new clock signal for use in the simultaneous digital-to-analog conversion of six sets of digital data by the 6-phase D/A converter 52. It is from the 12-V clock signal CK and inverse clock signal CKB, which are high-amplitude logic signals, that the step-down level shifters 54*a*, 54*b* which form low voltage clock signal generators controlled by means of the 3-V start pulse signal sp and inverse start pulse signal spb, which are low-amplitude logic signals, produce the 3-V clock signal ck and inverse clock signal ckb, which are low-amplitude logic signals. The clock signal ck and its inverse clock signal ckb, which are low-amplitude logic signals, and the start pulse signal SP, which is a high-amplitude logic signal stepped up to 12 V by the step-up level shifter 53, cause the shift registers 55 in which each stage has a step-up level shifter to operate. The sampling circuit 56 samples analog voltages obtained by the conversion by the 6-phase D/A converter 52 at timings determined by the shift registers 55 and feeds resultant outputs to data signal lines (not shown) to effect a display.

The clock wire in the shift registers 55 introduces load capacitance which is in direct proportion with the number of stages in the shift registers and the wiring of roughly the same length as the shift register. The En high-amplitude logic clock signal output from the shift registers 51 is converted to a low-amplitude logic signal by the step-down level shifters 54*a*, 54*b* which forms a low voltage clock signal generator before transmission. Therefore, electric power consumption is reduced. For example, in the example above, the voltage was lowered from 12 V to 3 V, and the electric power consumption by a clock wire is greatly reduced to 1/16. Further, lowering the voltage will lower unnecessary radiation.

In the present invention, the step-down level shifter shown in FIGS. 6-13 which is a low-voltage signal generator is used. The present invention may, however, be configured otherwise to produce a low-amplitude logic signal output from a high-amplitude logic signal input. The step-down level shifter which is a low-voltage signal generator operates in the same fashion as explained in embodiment 1.

The present invention is applicable not only to liquid crystal displays, but also to organic EL (OLED) and other active matrix displays.

As described in detail in the foregoing, the invention allows for the use of a low-amplitude logic signal as the signal transmitted along a load capacitance line linking multiple logic operation units in which a high-amplitude logic signal is required, thereby, achieving great reduction in electric power consumption and unnecessary radiation.

Embodiment 4

Figure 25:
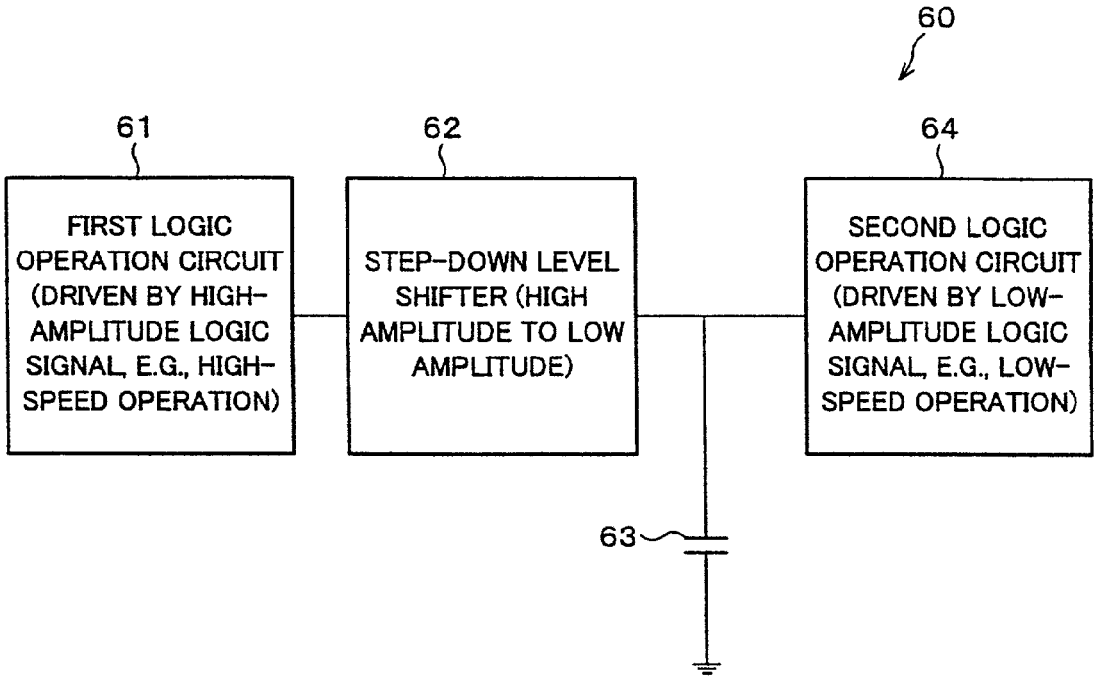
FIG. 25, in reference to another embodiment of the present invention, is a block diagram showing as an example a configuration of a signal processing circuit having a different circuit configuration from that in FIG. 22.
Figure 26:
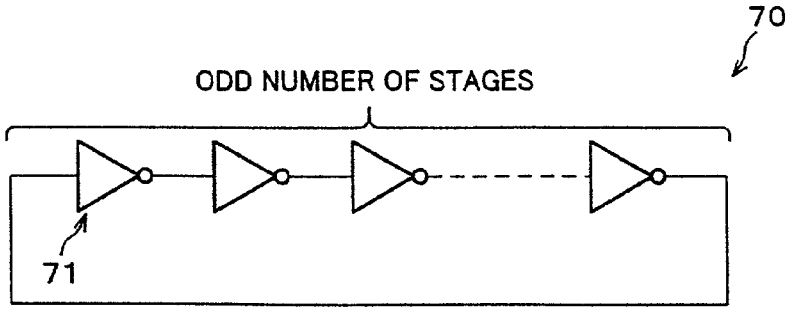
FIG. 26 is a schematic circuit diagram showing a configuration of a ring oscillator.
Figure 27:
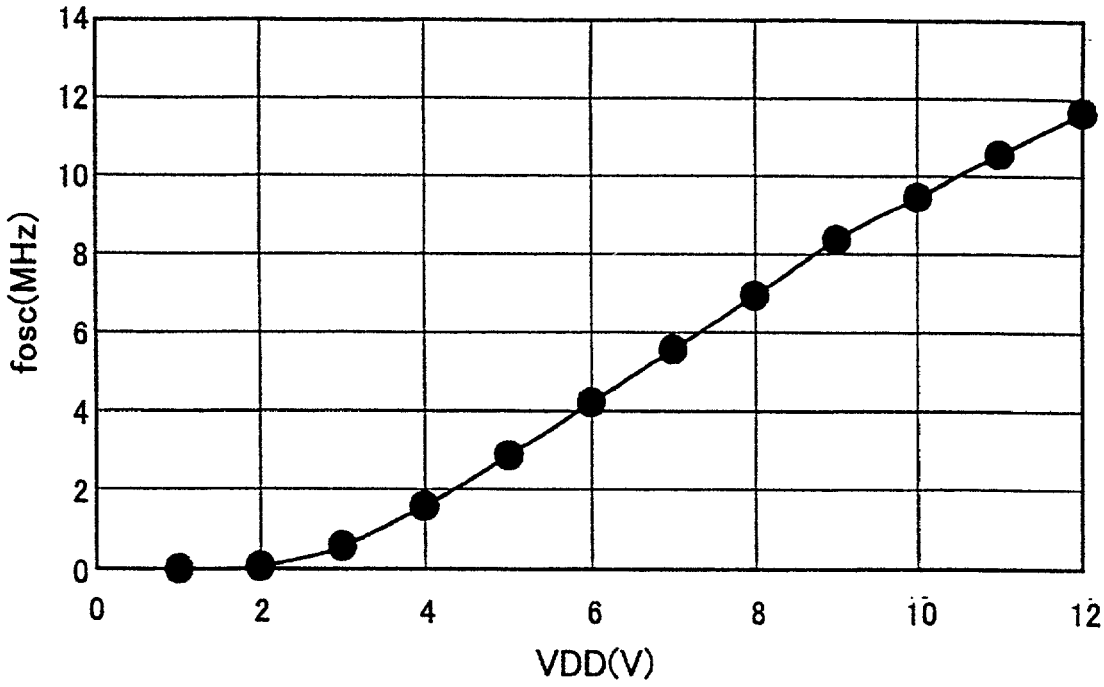
FIG. 27 is a graph showing dependence of oscillation frequency on source voltage in the ring oscillator in FIG. 26.
Figure 28:
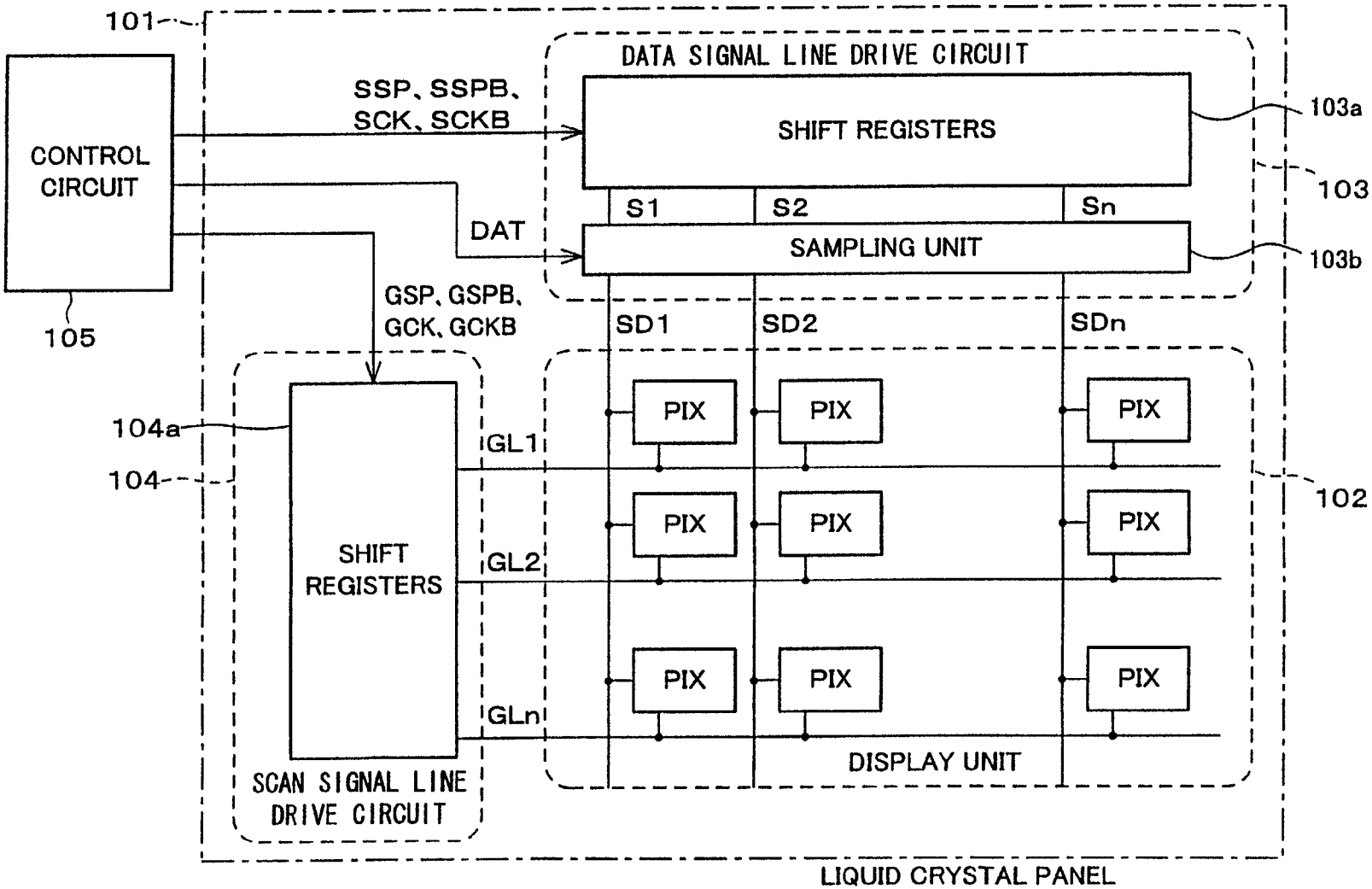
FIG. 28 is a block diagram showing as an example a configuration of a conventional monolithic active matrix image display with a high voltage interface.
Figure 29:
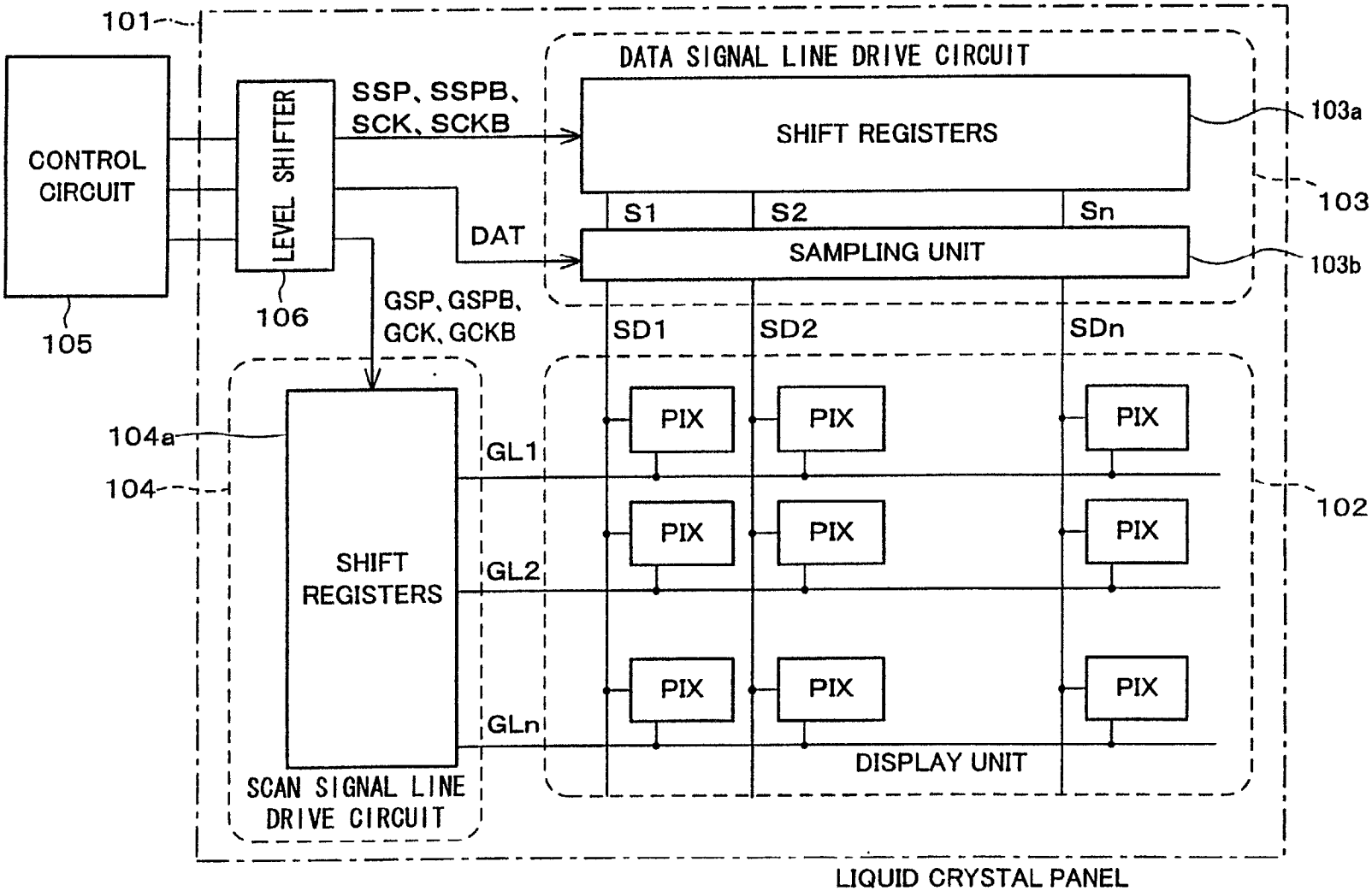
FIG. 29 is a block diagram showing as an example a configuration of a conventional monolithic active matrix image display with a low voltage interface.

Referring to FIGS. 25-27, the following will discuss another embodiment of the present invention. FIG. 25 schematically shows the configuration of a signal processing circuit of the present embodiment.

A signal processing circuit 60 is configured by: a first logic operation circuit 61 operating with a high-amplitude logic signal; a second logic operation circuit 64 operating with a low-amplitude logic signal which has a lower amplitude than the high-amplitude logic signal; and a transmission system 63 which introduces load capacitance between the first and second logic circuits 61, 64. Further, between the first logic operation circuit 61 and the transmission system 63, is there provided a low-voltage signal generator 62 which is a step-down level shifter for stepping down the high-amplitude logic signal to the low-amplitude logic signal.

Generally, a circuit is capable of operating at higher speed when it is provided with a higher source voltage. Referring to FIGS. 26, 27, the following will describe this fact by taking as a circuit example a ring oscillator frequently used to ensure the performance of transistors.

As shown in FIG. 26, a ring oscillator 70 is constituted by inverters 71 forming an odd number of stages so that the output of the inverter 71 in the last stage is the input of the inverter 71 in the first stage. The inverters 71 transforms a high signal input to a low signal output and vice versa. Thus, the ring oscillator 70, constituted by inverters 71 forming an odd number of stages, oscillates. The higher the performance of transistors, the higher the frequency at which the ring oscillator 70 oscillates.

FIG. 27 shows the dependence of the oscillation frequency on a source voltage of the ring oscillator 70. The ring oscillator 70 used here includes inverters 71 forming 19 stages. Each inverter 71 includes n-type polysilicon transistors having a channel length L of 6 μm and a channel width W of 8 μm and p-type polysilicon transistors having a channel length L of 6 μm and a channel width W of 6 μm.

It would be understood from FIG. 27 that the oscillation frequency fosc of the ring oscillator increases with an increase in the source potential Vdd. For example, the oscillation frequency fosc is about 1.5 MHz when the source potential Vdd is 4 V, and about 12 MHz when 12 V.

The source voltage can therefore be set to a low value for those circuits which are allowed to carry out a process at low speed. The second logic operation circuit 64 in FIG. 25 may be driven by a low-amplitude logic signal if it is allowed to carry out a process at lower speed than the first logic operation circuit 61.

Under these circumstances, the step-down level shifter 62 transmits a low-amplitude logic signal to the transmission system 63. Accordingly, no step-up level shifter 34 needs to be provided between the transmission system 63 and the second logic operation circuit 64, as shown in FIG. 22, so as to transform a low-amplitude logic signal to a high-amplitude logic signal, effectively preventing increases in circuit dimensions.

Referring to FIGS. 22, 25, the step-down level shifter 62 transmits a low-amplitude logic signal to the transmission system 63, regardless of whether the second logic operation circuits 35, 64 operate with a high-amplitude logic signal or a low-amplitude logic signal. Therefore, the circuit configuration greatly reduces unnecessary radiation and the electric power consumption, in the load capacitance wire, which is in direct proportion to the square of the voltage.

The present embodiment is applicable to a wide range of monocrystalline-silicon-based circuits and polysilicon-based circuits. The present embodiment is applicable not only to liquid crystal displays, but also to organic EL (OLED) and other active matrix displays.

As described in the foregoing, a signal processing circuit in accordance with the present invention is configured to include:

a first logic operation circuit which performs a logic operation using a high-amplitude logic signal;

a transmission system having a load capacitance; and a low-voltage signal generator which is a step-down level shifter transforming an incoming high-amplitude logic signal from the first logic operation circuit to a low-amplitude logic signal having a lower amplitude than the high-amplitude logic signal for output to the transmission system The first logic operation circuit operates based on a high-amplitude logic signal, and therefore free from malfunctions and operates at high speed. Further, the transmission system introducing a load capacitance operates based on a low-amplitude logic signal and therefore consumes reduced electric power in transmitting the output signal of the first logic operation circuit. Therefore, in the configuration including a logic operation unit which requires a high-amplitude logic signal, the present invention is effective in restraining increases in electric power consumption and occurrence of unnecessary radiation.

The second logic operation circuit connected to the transmission system may be a circuit performing a logic operation based on a low-amplitude logic signal or a high-amplitude logic signal. For example, the logic operation circuit built around a silicon thin film transistor made of polysilicon should be driven by means of a high-amplitude logic signal if the circuit is required to handle high-speed processing, but may be sufficiently driven by means of a low-amplitude logic signal if it is required to handle only low-speed processing. The foregoing configuration in which is there provided a step-down level shifter between a first logic operation circuit and a transmission system is effective in better restraining increases in electric power consumption and occurrence of unnecessary radiation than a configuration in which is there provided a step-down level shifter between a transmission system and a second logic operation circuit.

If the second logic operation circuit performs a logic operation based on a high-amplitude logic signal, there is provided between the transmission system and the second logic operation circuit a step-up level shifter which transforms an incoming low-amplitude logic signal from the transmission system to a high-amplitude logic signal having a higher amplitude than the low-amplitude logic signal for output to the second logic operation circuit. Thus, the second logic operation circuit also operates based on a high-amplitude logic signal, and is therefore free from malfunctions and operates at high speed. The high-amplitude logic signal used in the first logic operation circuit may have the same or a different amplitude from that of the high-amplitude logic signal used in the second logic operation circuit.

Meanwhile, if the second logic operation circuit performs a logic operation based on a low-amplitude logic signal, there is no need to provide a step-up level shifter between the transmission system and the second logic operation circuit, resulting in space savings in the circuit.

As described above, the signal processing circuit in accordance with the present invention has the foregoing structure and further configured so that at least either the first logic operation circuit or the second logic operation circuit is constituted by a silicon thin film transistor made of polysilicon.

According to the configuration, either the first logic operation circuit and the second logic operation circuit is constituted by a silicon thin film transistor made of polysilicon; therefore, in addition to the effects of the foregoing configuration, the present invention is more versatile to match itself to downstream circuitry.

A low-voltage signal generator in accordance with the present invention, as described in the foregoing, is provided in a signal processing circuit including:

a first logic operation circuit which performs a logic operation using a high-amplitude logic signal; and a transmission system having a load capacitance, wherein the low-voltage signal generator is configured to transform a high-amplitude logic signal to a low-amplitude logic signal having a lower amplitude than the high-amplitude logic signal. The low-voltage signal generator is preferably provided between an output of the first logic operation circuit and the transmission system.

According to the configuration, as earlier mentioned, the first logic operation circuit operates based on a high-amplitude logic signal, and is therefore free from malfunctions and operates at high speed, whereas the transmission system introducing load capacitance operates based on a low-amplitude logic signal, and therefore consumes reduced electric power in transmitting the output signal of the first logic operation circuit. Therefore, in the configuration including a logic operation unit which requires a high-amplitude logic signal, the present invention is effective in restraining increases in electric power consumption and occurrence of unnecessary radiation.

That is, the present invention is effective in offering a low-voltage signal generator which is provided in a signal processing circuit including a logic operation unit which depends on a high-amplitude logic signal for operation and a transmission system which preferably operates based on a low-amplitude logic signal to reduce electric power consumption and which is a step-down level shifter capable of producing a low-amplitude logic signal from a high-amplitude logic signal.

As described in the foregoing, a low-voltage signal generator in accordance with the present invention has the foregoing structure and is further configured to include transistors forming a gate circuit, wherein:

each transistor belongs to either a low level output group or a high level output group;

each transistor belonging to the low level output group is fed at a gate thereof with the high-amplitude logic signal and at an input end thereof with any one of a low-amplitude logic signal which remains at a low level throughout a period in which the high-amplitude logic signal is applied to the gate, a low level potential from a low level source for use to produce the low-amplitude logic signal, and a low level potential from a high level source for use to produce the high-amplitude logic signal, and outputs a low level potential of a low-amplitude logic signal through an output end thereof; and each transistor belonging to the high level output group is fed at a gate thereof with the high-amplitude logic signal and at an input end thereof with either one of a low-amplitude logic signal which remains at a high level throughout the period and a high level potential from the low level source, and outputs a high level potential of a low-amplitude logic signal through an output end thereof.

According to the configuration, each transistor outputs a low-amplitude logic signal by opening/closing the gate circuit by means of the high-amplitude logic signal; therefore, in addition to the effects of the foregoing configuration, the present invention is effective in delivering the aforementioned low-voltage signal generator with a simple configuration.

Another low-voltage signal generator in accordance with the present invention, as described in the foregoing, has the foregoing structure and is further configured so that:

the signal processing circuit is used in an image display including pixels arranged in a matrix, data signal lines each provided for a different column of pixels, scan signal lines each provided for a different row of pixels, a data signal line drive circuit driving the data signal lines, and a scan signal line drive circuit driving the scan signal lines;

the low-amplitude logic signal which remains at a low level throughout a period in which the high-amplitude logic signal is applied to the gate is a start pulse signal representing when the data signal line drive circuit starts to operate; and the low-amplitude logic signal which remains at a high level throughout a period in which the high-amplitude logic signal is applied to the gate is an inverse signal of the start pulse signal.

According to the configuration, each transistor outputs a low-amplitude logic signal by opening/closing the gate by means of the high-amplitude logic signal; therefore, in addition to the effects of the foregoing configuration, the present invention is effective in delivering the aforementioned low-voltage signal generator with a simple configuration.

Another low-voltage signal generator in accordance with the present invention, as described in the foregoing, has the foregoing structure and is further configured so that each transistor outputs the low-amplitude logic signal and an inverse signal thereof.

According to the configuration, each transistor outputs the low-amplitude logic signal and its inverse signal; therefore, in addition to the effects of the foregoing configuration, the present invention is more versatile to match itself to downstream circuitry.

Another low-voltage signal generator in accordance with the present invention, as described in the foregoing, has the foregoing structure and is further configured so as to be constituted by a silicon thin film transistor made of polysilicon.

According to the configuration, at least either one of the first logic operation circuit and the second logic operation circuit or the low-voltage signal generator is constituted by a silicon thin film transistor made of polysilicon; therefore, in addition to the effects of the foregoing configuration, the present invention is more versatile to match itself to downstream circuitry.

An image display in accordance with the present invention, as described in the foregoing, includes: pixels arranged in a matrix; data signal lines each provided for a different column of pixels; scan signal lines each provided for a different row of pixels; a data signal line drive circuit driving the data signal lines; and a scan signal line drive circuit driving the scan signal lines, and is configured so that either one, or both, of the data signal line drive circuit and the scan signal line drive circuit include(s): a first logic operation circuit which performs a logic operation using a high-amplitude logic signal; a transmission system having a load capacitance; and a low-voltage signal generator which is a step-down level shifter transforming an incoming high-amplitude logic signal from the first logic operation circuit to a low-amplitude logic signal having a lower amplitude than the high-amplitude logic signal for output to the transmission system.

Therefore, for example, a circuit which divides an incoming clock signal in terms of frequency as the first logic operation circuit operates based on a high-amplitude logic signal, and is hence free from malfunctions and operates at high speed. Further, the transmission system introducing a load capacitance operates based on a low-amplitude logic signal, and therefore consumes reduced power in transmitting the output signal of the first logic operation circuit. The present invention thereby achieves high-speed logic operation capability and reduced electric power consumption with an image display.

The second logic operation circuit connected to the transmission system may be a circuit performing a logic operation based on a low-amplitude logic signal or a high-amplitude logic signal. The foregoing configuration in which is there provided a step-down level shifter between a first logic operation circuit and a transmission system is effective in better restraining increases in electric power consumption and occurrence of unnecessary radiation than a configuration in which is there provided a step-down level shifter between a transmission system and a second logic operation circuit.

If the second logic operation circuit performs a logic operation based on a high-amplitude logic signal, there is provided between the transmission system and the second logic operation circuit a step-up level shifter which transforms an incoming low-amplitude logic signal from the transmission system to a high-amplitude logic signal having a higher amplitude than the low-amplitude logic signal for output to the second logic operation circuit. Thus, for example, a shift register as the second logic operation circuit also operates based on a high-amplitude logic signal, and is therefore free from malfunctions and operates at high speed. The high-amplitude logic signal used in the first logic operation circuit may have the same or a different amplitude from that of the high-amplitude logic signal used in the second logic operation circuit.

Meanwhile, if the second logic operation circuit performs a logic operation based on a low-amplitude logic signal, there is no need to provide a step-up level shifter between the transmission system and the second logic operation circuit, resulting in space savings in the circuit.

Another image display in accordance with the present invention, as described in the foregoing, has the foregoing structure and is further configured so that:

the first logic operation circuit is a clock frequency dividing circuit for dividing a clock signal in terms of frequency, the second logic operation circuits are shift registers connected in series, and the shift registers are connected to the step-up level shifter.

According to the configuration, the step-down level shifter as a low-voltage signal generator steps down the output of the clock frequency dividing circuit; therefore, in addition to the effects of the foregoing configuration, the present invention is effective in delivering the aforementioned image display with a simple configuration.

Another image display in accordance with the present invention, as described in the foregoing, has the foregoing structure and is further configured so that the first logic operation circuit is an inverse clock signal circuit which produces an inverse clock signal from a clock signal, the second logic operation circuits are shift registers connected in series, and the shift registers are connected to the step-up level shifter.

According to the configuration, the step-down level shifter as a low-voltage signal generator steps down the inverse clock signal produced by the inverse clock signal circuit; therefore, in addition to the effects of the foregoing configuration, the present invention is effective in delivering the aforementioned image display with a simple configuration.

Another image display in accordance with the present invention, as described in the foregoing, has the foregoing structure and is further configured so that the data signal line drive circuit includes the step-down level shifter which is the low-voltage signal generator, the first logic operation circuit is a circuit in which shift registers are connected in series and is a first shift register circuit which is a circuit determining a timing to sample digital data, and the second logic operation circuit is a circuit in which shift registers are connected in series and is a second shift register circuit which is a circuit determining a timing to output to the data signal lines.

According to the configuration, the step-down level shifter which is the low-voltage signal generator steps down the output of the first shift register; therefore, in addition to the effects of the foregoing configuration, the present invention is effective in delivering the aforementioned image display with a simple configuration.

Another image display in accordance with the present invention is, as described in the foregoing, has the foregoing structure and is further configured so that at least the first logic operation circuit is constituted by a silicon thin film transistor made of polysilicon.

According to the configuration, at least the first logic operation circuit is constituted by a silicon thin film transistor made of polysilicon; therefore, in addition to the effects of the foregoing configuration, the present invention is more versatile to match itself to downstream circuitry.

Another signal processing circuit in accordance with the present invention may be a device including logic operation units and a transmission system introducing a load, or in other words, a circuit including logic operation circuits 1, 2 depending on a high-amplitude logic signal for operation and a load capacitance interposed between the circuits 1, 2, and is configured so that there is provided a step-down level shifter transforming a high-amplitude logic signal to a low-amplitude logic signal between the logic operation circuit 1 and the load capacitance and a step-up level shifter transforming a low-amplitude logic signal to a high-amplitude logic signal between the load capacitance and the logic operation circuit 2.

Another low-voltage signal generator in accordance with the present invention may have the foregoing structure and be further configured so as to include a step-down level shifter characterized in its capability to transform a high-amplitude logic signal to a low-amplitude logic signal.

Another signal processing circuit in accordance with the present invention may have the foregoing structure and be further configured so that: a high-amplitude logic signal is coupled the gate of a transistor forming a path gate; the source is coupled to either a low-amplitude logic signal or a high level source potential of a low-amplitude logic signal or a low level source potential of a high-amplitude logic signal and a low-amplitude logic signal; and a low-amplitude logic signal output is produced.

Another signal processing circuit in accordance with the present invention may have the foregoing structure and be further configured so that a low-amplitude logic signal coupled to the source of a transistor is a start pulse signal or an inverse start pulse signal.

Another signal processing circuit in accordance with the present invention may have the foregoing structure and be further configured so that a low-amplitude logic signal coupled to the source of a transistor is an inverse start pulse signal or a low level source potential of a high-amplitude logic signal and a low-amplitude logic signal.

Another signal processing circuit in accordance with the present invention may have the foregoing structure and be further configured so that the low-amplitude logic signal coupled to the source of a transistor is either a start pulse signal or a high level source potential of a low-amplitude logic signal.

Another signal processing circuit in accordance with the present invention may have the foregoing structure and be further configured so that a high level source potential of a low-amplitude logic signal or a low level of a low-amplitude logic signal is coupled to the source of a transistor.

Another signal processing circuit in accordance with the present invention may have the foregoing structure and be further configured so that: a high-amplitude logic signal is coupled to the gate of a transistor forming a path gate; the source is coupled to either a low-amplitude logic signal or a high level source potential of a low-amplitude logic signal or a low level source potential of a high-amplitude logic signal and a low-amplitude logic signal; and a low-amplitude logic signal output and an inverse output are produced.

Another signal processing circuit in accordance with the present invention may have the foregoing structure and be further configured so that any of these logic operation circuits is(are) composed of polysilicon.

This greatly reduces the electric power consumption in capacitive load wiring which varies in direct proportion to the square of voltage and hence unnecessary radiation.

Another image display in accordance with the present invention may include:

pixels arranged in a matrix;

data signal lines each provided for a different row of pixels;

scan signal lines each provided for a different column of pixels;

a scan signal line drive circuit sequentially addressing the scan signal lines with a scan signal at different timings in synchronism with a first clock signal having a predetermined cycle; and a data signal line drive circuit acquiring data signals to be fed to those pixels on a scan signal line addressed by means of the scan signal from an incoming video signal, representative of a display state of each pixel, which is sequentially fed in synchronism with a second clock signal having a predetermined cycle, for outputs to the data signal lines, and be configured so as to include the foregoing signal processing circuit or step-down level shifter.

Another image display in accordance with the present invention may have the foregoing structure and be further configured so as to include a data signal line drive circuit constituted by:

a level shifter which steps up an incoming clock signal;

a subsequently positioned clock frequency dividing circuit;

a level shifter which steps down an output of the frequency dividing circuit;

shift registers each having a step-up level shifter; and a sampling circuit which controls outputs to the data signal lines. This greatly reduces the electric power consumption in capacitive load wiring and hence unnecessary radiation.

Another image display in accordance with the present invention may have the foregoing structure and be further configured so as to include a data signal line drive circuit constituted by:

a circuit which receives a clock signal and produces an inverse clock signal;

a level shifter which steps down the inverse clock signal;

shift registers each having a step-up level shifter; and a sampling circuit which controls outputs to the data signal lines This greatly reduces the electric power consumption in capacitive load wiring and hence unnecessary radiation.

Another image display in accordance with the present invention may have the foregoing structure and be further configured so as to include a data signal line drive circuit constituted by:

first shift registers each having a step-up level shifter to determine a digital data sampling timing;

a level shifter which steps down an output of the first shift register;

a digital analog converter;

second shift registers each having a step-up level shifter to determine a timing to output to the data signal lines; and a sampling circuit which controls outputs to the data signal lines. This greatly reduces the electric power consumption in capacitive load wiring and hence unnecessary radiation.

Another image display in accordance with the present invention may have the foregoing structure and be further configured so as to include a scan line signal line drive circuit constituted by:

a level shifter which steps up an incoming clock signal;

a subsequently positioned clock frequency dividing circuit;

a level shifter which steps down an output of the frequency dividing circuit; and shift registers each having a step-up level shifter.

This greatly reduces the electric power consumption in capacitive load wiring and hence unnecessary radiation.

Another image display in accordance with the present invention may have the foregoing structure and be further configured so as to include a scan line drive circuit constituted by:

a circuit which receives a clock signal and produces an inverse clock signal;

a level shifter which steps down the inverse clock signal; and shift registers each having a step-up level shifter. This greatly reduces the electric power consumption in capacitive load wiring and hence unnecessary radiation.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A low-voltage signal generator provided in a signal processing integrated circuit including integrated therein circuits requiring high-amplitude logic signals and circuits operable with low-amplitude logic signals, comprising all within the integrated circuit:

a first logic operation circuit which performs a logic operation using a high-amplitude logic signal;

a transmission system having a load capacitance, wherein the low-voltage signal generator transforms a high-amplitude logic signal to a low-amplitude logic signal having a lower amplitude than the high-amplitude logic signal; and transistors forming a gate circuit, wherein: each transistor belongs to either a low level output group or a high level output group; and each transistor belonging to the low level output group is fed at a gate thereof with the high-amplitude logic signal and at an input end thereof with any one of a low-amplitude logic signal which remains at a low level throughout a period in which the high-amplitude logic signal is applied to the gate, a low level potential from a low level source for use to produce the low-amplitude logic signal, and a low level potential from a high level source for use to produce the high-amplitude logic signal, and outputs a low level potential of a low-amplitude logic signal through an output end thereof; and each transistor belonging to the high level output group is fed at a gate thereof with the high-amplitude logic signal and at an input end thereof with either one of a low-amplitude logic signal which remains at a high level throughout the period and a high level potential from the low level source, and outputs a high level potential of a low-amplitude logic signal through an output end thereof.

2. The low-voltage signal generator as set forth in claim 1, provided between an output end of the first logic operation circuit and the transmission system.

3. The low-voltage signal generator as set forth in claim 1, wherein:

the signal processing circuit is used in an image display including pixels arranged in a matrix, data signal lines each provided for a different column of pixels, scan signal lines each provided for a different row of pixels, a data signal line drive circuit driving the data signal lines, and a scan signal line drive circuit driving the scan signal lines;

the low-amplitude logic signal which remains at a low level throughout the period is a start pulse signal representing when the data signal line drive circuit starts to operate; and the low-amplitude logic signal which remains at a high level throughout the period is an inverse signal of the start pulse signal.

4. The low-voltage signal generator as set forth in the claim 1, wherein each transistor outputs the low-amplitude logic signal and an inverse signal thereof.

5. The low-voltage signal generator as set forth in the claim 1, constituted by a silicon thin film transistor made of polysilicon.

6. An image display, comprising: pixels arranged in a matrix; data signal lines each provided for a different column of pixels; scan signal lines each provided for a different row of pixels; a data signal line drive circuit driving the data signal lines; and a scan signal line drive circuit driving the scan signal lines, wherein either one, or both, of the data signal line drive circuit and the scan signal line drive circuit include(s): a first logic operation circuit which performs a logic operation using a high-amplitude logic signal; a transmission system having a load capacitance; and a low-voltage signal generator which is a step-down level shifter transforming an incoming high-amplitude logic signal from the first logic operation circuit to a low-amplitude logic signal having a lower amplitude than the high-amplitude logic signal for output to the transmission system.

7. The image display as set forth in claim 6, further comprising:

a second logic operation circuit which is connected to the transmission system to perform a logic operation using the low-amplitude logic signal fed from the step-down level shifter through the transmission system.

8. The image display as set forth in claim 6, further comprising:

a step-up level shifter which transforms an incoming low-amplitude logic signal from the transmission system to a high-amplitude logic signal having a higher amplitude than the low-amplitude logic signal for output; and a second logic operation circuit which performs a logic operation using the incoming high-amplitude logic signal from the step-up level shifter.

9. The image display as set forth in claim 8, wherein the first logic operation circuit is a clock frequency dividing circuit for dividing a clock signal in terms of frequency, the second logic operation circuits are shift registers connected in series, and the shift registers are connected to the step-up level shifters respectively.

10. The image display as set forth in claim 8, wherein the first logic operation circuit is an inverse clock signal circuit which produces an inverse clock signal from a clock signal, the second logic operation circuits are shift registers connected in series, and the shift registers are connected to the step-up level shifters respectively.

11. The image display as set forth in claim 8, wherein the data signal line drive circuit includes the step-down level shifter which is the low-voltage signal generator, the first logic operation circuit is a circuit in which shift registers are connected in series and is a first shift register circuit which is a circuit determining a timing to sample digital data, and the second logic operation circuit is a circuit in which shift registers are connected in series and is a second shift register circuit which is a circuit determining a timing to output to the data signal lines.

12. The image display as set forth in claim 6, wherein at least the first logic operation circuit is constituted by a silicon thin film transistor made of polysilicon.

13. A low-voltage signal generator provided in a signal processing circuit including:

a first logic operation circuit which performs a logic operation using a high-amplitude logic signal;

a transmission system having a load capacitance, wherein the low-voltage signal generator transforms a high-amplitude logic signal to a low-amplitude logic signal having a lower amplitude than the high-amplitude logic signal;

transistors forming a gate circuit, wherein:

each transistor belongs to either a low level output group or a high level output group;

each transistor belonging to the low level output group is fed at a gate thereof with the high-amplitude logic signal and at an input end thereof with any one of a low-amplitude logic signal which remains at a low level throughout a period in which the high-amplitude logic signal is applied to the gate, a low level potential from a low level source for use to produce the low-amplitude logic signal, and a low level potential from a high level source for use to produce the high-amplitude logic signal, and outputs a low level potential of a low-amplitude logic signal through an output end thereof; and each transistor belonging to the high level output group is fed at a gate thereof with the high-amplitude logic signal and at an input end thereof with either one of a low-amplitude logic signal which remains at a high level throughout the period and a high level potential from the low level source, and outputs a high level potential of a low-amplitude logic signal through an output end thereof.

14. The low-voltage signal generator as set forth in claim 13, wherein:

the signal processing circuit is used in an image display including pixels arranged in a matrix, data signal lines each provided for a different column of pixels, scan signal lines each provided for a different row of pixels, a data signal line drive circuit driving the data signal lines, and a scan signal line drive circuit driving the scan signal lines;

the low-amplitude logic signal which remains at a low level throughout the period is a start pulse signal representing when the data signal line drive circuit starts to operate; and the low-amplitude logic signal which remains at a high level throughout the period is an inverse signal of the start pulse signal.

15. The low-voltage signal generator as set forth in the claim 13, wherein each transistor outputs the low-amplitude logic signal and an inverse signal thereof.

16. The image display of claim 6, wherein the transmission system includes a clock wire.

17. The image display of claim 16, wherein the clock wire provides a clock signal for a shift register.

18. The image display of claim 6, wherein the transmission system connects the low-voltage signal generator to a high-voltage signal generator which comprises a step-up level shifter transforming an incoming low-amplitude logic signal from the transmission system to a high-amplitude logic signal, and wherein the transmission system supplies the low-amplitude logic signal output by the low-voltage signal generator as an incoming low-amplitude logic signal sent to the step-up level shifter.

* * * * *